US010383392B2

(12) United States Patent
Langvin

(10) Patent No.: US 10,383,392 B2
(45) **Date of Patent: *Aug. 20, 2019**

(54) FOOTWEAR HAVING AUXETIC STRUCTURES WITH CONTROLLED PROPERTIES

(71) Applicant: NIKE, Inc., Beaverton, OR (US)

(72) Inventor: Elizabeth Langvin, Sherwood, OR (US)

(73) Assignee: NIKE, Inc., Beaverton, OR (US)

( * ) Notice: Subject to any disclaimer, the term of this patent is extended or adjusted under 35 U.S.C. 154(b) by 138 days.

This patent is subject to a terminal disclaimer.

(21) Appl. No.: 15/263,548

(22) Filed: Sep. 13, 2016

(65) Prior Publication Data

US 2016/0374429 A1 Dec. 29, 2016

Related U.S. Application Data

(63) Continuation of application No. 14/329,483, filed on Jul. 11, 2014, now Pat. No. 9,474,326.

(51) Int. Cl.

| | |
|---|---|
| ***A43B 13/18*** | (2006.01) |
| ***A43B 13/12*** | (2006.01) |
| ***A43B 13/02*** | (2006.01) |
| ***A43B 13/22*** | (2006.01) |
| ***A43C 15/16*** | (2006.01) |
| ***A43B 5/00*** | (2006.01) |
| ***A43B 13/42*** | (2006.01) |

(Continued)

(52) U.S. Cl.

CPC ..... *A43B 13/186* (2013.01); *A43B 5/00* (2013.01); *A43B 13/026* (2013.01); *A43B 13/04* (2013.01); *A43B 13/122* (2013.01); *A43B 13/14* (2013.01); *A43B 13/141* (2013.01); *A43B 13/181* (2013.01); *A43B 13/187* (2013.01); *A43B 13/188* (2013.01); *A43B 13/223* (2013.01); *A43B 13/32* (2013.01); *A43B 13/42* (2013.01); *A43B 17/00* (2013.01); *A43C 15/16* (2013.01)

(58) Field of Classification Search

CPC ..... A43B 13/181; A43B 13/14; A43B 13/187; A43B 13/42; A43B 5/00; A43B 17/00; A43B 1/0009; A43D 31/00; A43D 31/0005; A43D 31/02

See application file for complete search history.

(56) References Cited

U.S. PATENT DOCUMENTS 3,834,046 A * 9/1974 Fowler ..... A43B 13/181 36/28

4,779,361 A 10/1988 Kinsaul (Continued)

FOREIGN PATENT DOCUMENTS

JP H08275805 A 10/1996
KR 101165793 B1 7/2012

OTHER PUBLICATIONS

David Skinner, "Water Shoe Summer Round-Up", Trek Tech Blog, Aug. 26, 2012.

*Primary Examiner* — Jila M Mohandesi
(74) *Attorney, Agent, or Firm* — Quinn IP Law

(57) ABSTRACT

An article of footwear includes a sole incorporating an auxetic structure. The article of footwear further includes a strobel that may be placed along the auxetic structure of the sole. The strobel may restrict the motion of the auxetic structure in particular locations. The strobel may be used to provide rigidity and support in the area of the strobel.

13 Claims, 23 Drawing Sheets

(51) Int. Cl.

| | |
|---|---|
| ***A43B 17/00*** | (2006.01) |
| ***A43B 13/14*** | (2006.01) |
| ***A43B 13/04*** | (2006.01) |
| ***A43B 13/32*** | (2006.01) |

(56) References Cited

U.S. PATENT DOCUMENTS

| | | | | | |
|---|---|---|---|---|---|
| 5,402,588 | A * | 4/1995 | Graham | A43B 1/0072 | 36/114 |
| 5,595,002 | A * | 1/1997 | Slepian | A43B 1/0072 | 36/114 |
| 5,729,917 | A * | 3/1998 | Slepian | A43B 13/181 | 36/27 |
| 6,115,945 | A | 9/2000 | Ellis, III | | |
| 6,446,359 | B2 * | 9/2002 | Tomat | A43B 7/08 | 36/28 |
| 7,254,906 | B2 * | 8/2007 | Morris | A43B 7/06 | 36/27 |
| 8,084,117 | B2 * | 12/2011 | Lalvani | B32B 3/266 | 428/135 |
| 2007/0122590 | A1 | 5/2007 | Lalvani | | |

* cited by examiner

FOOTWEAR HAVING AUXETIC STRUCTURES WITH CONTROLLED PROPERTIES

CROSS-REFERENCE TO RELATED APPLICATIONS

This application is a continuation of Langvin, U.S. patent application Ser. No. 14/329,483, now Patent Application Publication Number 2016/0007681, published Jan. 14, 2016, and entitled "Footwear Having Auxetic Structures With Controlled Properties," the entire disclosure of which is incorporated herein by reference.

BACKGROUND

Articles of footwear typically have at least two major components, an upper that provides the enclosure for receiving the wearer's foot, and a sole secured to the upper that is the primary contact to the ground or playing surface. The footwear may also use some type of fastening system, for example, laces or straps or a combination of both, to secure the footwear around the wearer's foot. The sole may comprise three layers—an inner sole, a midsole and an outer sole. The outer sole is the primary contact to the ground or the playing surface. It generally carries a tread pattern and/or cleats, spikes or other protuberances that provide the wearer of the footwear with improved traction suitable to the particular athletic, work or recreational activity, or to a particular ground surface.

SUMMARY

In one aspect, an article of footwear includes an upper, a sole, and a strobel. The sole includes a first direction and a second direction, the first direction being orthogonal to the first direction. The sole is configured to expand in both the first direction and the second direction when the sole is tension in the first direction. The sole has a first stretch resistance in the first direction. The strobel is attached to the sole. The strobel has a second stretch resistance in the first direction, the second stretch resistance being greater than the first stretch resistance.

In another aspect, the sole structure includes a sole and a strobel. The sole includes an auxetic structure. The auxetic structure includes a plurality of apertures surrounded by a plurality of portions. Each aperture has a plurality of sides defined by a group of portions surrounding the aperture. The plurality of apertures includes a first aperture associated with a first group of portions. The first group of portions includes a first portion and a second portion. The first portion is joined to the second portion at a hinge portion. The first portion and the second portion are able to rotate with respect to each other about the hinge portion. The first portion and the second portion rotate away from one another when a tensioning force is applied at the hinge portion in a first direction, where the first direction is oriented away from the first aperture. The strobel is attached to a least a portion of the sole. The strobel is configured to limit the amount of rotation between the first portion and the second portion.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

The foregoing Summary and the following Detailed Description will be better understood when read in conjunction with the accompanying Figures.

DETAILED DESCRIPTION

Figure 1:
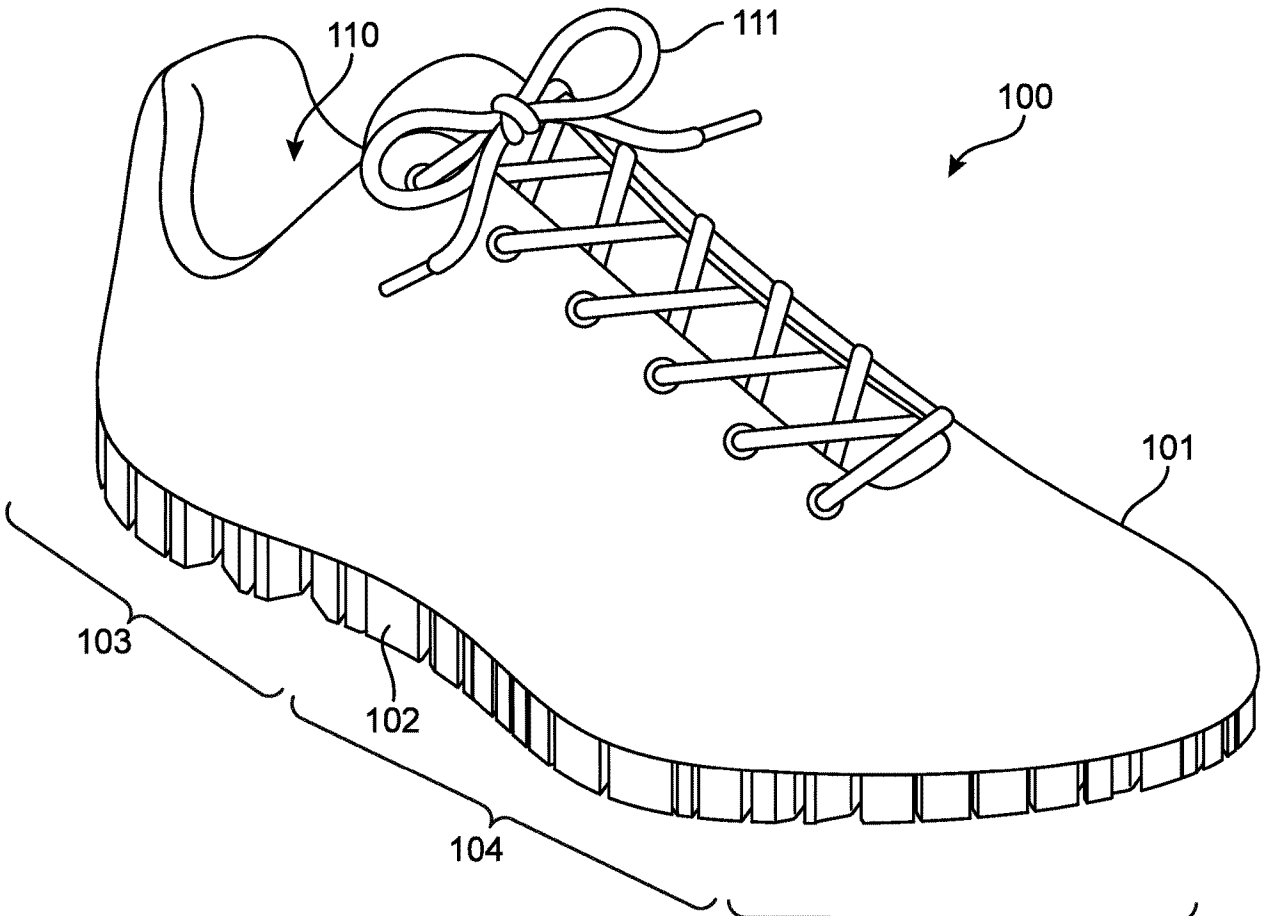
FIG. 1 is an isometric view of an exemplary embodiment of an article of footwear.

For clarity, the detailed descriptions herein describe certain exemplary embodiments, but the disclosure herein may be applied to any article of footwear comprising certain features described herein and recited in the claims. In particular, although the following detailed description discusses exemplary embodiments in the form of footwear such as running shoes, jogging shoes, tennis, squash or racquetball shoes, basketball shoes, sandals and flippers, the disclosures herein may be applied to a wide range of footwear or possibly other kinds of articles.

For consistency and convenience, directional adjectives are employed throughout this detailed description corresponding to the illustrated embodiments. The term "longitudinal direction" as used throughout this detailed description and in the claims refers to a direction extending from heel to toe, which may be associated with the length, or longest dimension, of an article of footwear such as a sports or recreational shoe. Also, the term "lateral direction" as used throughout this detailed description and in the claims refers to a direction extending from side to side (lateral side and medial side) or the width of an article of footwear. The lateral direction may generally be perpendicular to the longitudinal direction. The term "vertical direction" as used with respect to an article of footwear throughout this detailed description and in the claims refers to the direction that is normal to the plane of the sole of the article of footwear. Moreover, the vertical direction may generally be perpendicular to both the longitudinal direction and the lateral direction.

The term "sole" as used herein shall refer to any combination that provides support for a wearer's foot and bears the surface that is in direct contact with the ground or playing surface, such as a single sole; a combination of an outsole and an inner sole; a combination of an outsole, a midsole and an inner sole, and a combination of an outer covering, an outsole, a midsole and an inner sole.

As used herein, the term "auxetic structure" or "reactive structure" generally refers to a structure that, when placed under tension in a first direction, the structure increases its dimensions in a direction that is orthogonal to the first direction. Such auxetic structures are characterized by having a negative Poisson's ratio. For example, if the structure can be described as having a length, a width and a thickness, then when the structure is under tension longitudinally, the structure also increases in width. In certain embodiments, the auxetic structures are bi-directionally reactive such that they increase in length and width when stretched longitudinally and in width and length when stretched laterally, but do not increase in thickness. Also, although such auxetic structures will generally have at least a monotonic relationship between the applied tension and the increase in the dimension orthogonal to the direction of the tension, that relationship need not be proportional or linear, and in general need only increase in response to increased tension.

An article of footwear may include an upper and a sole. The sole may include an inner sole, a midsole and an outer sole. The sole includes at least one layer made of an auxetic structure. This layer can be referred to as an "auxetic layer" (or "reactive layer"). When the person wearing the footwear engages in an activity, such as running, turning, leaping or accelerating, that puts the auxetic layer under increased longitudinal or lateral tension, the auxetic layer increases in length and width and thus provides improved traction. This expansion of the auxetic material may also help to absorb some of the impact with the playing surface. Although the descriptions below only discuss a limited number of types of footwear, embodiments can be adapted for many sport and recreational activities, including tennis and other racquet sports, walking, jogging, running, hiking, handball, training, running or walking on a treadmill, as well as team sports such as basketball, volleyball, lacrosse, field hockey and soccer.

FIG. 1 is an isometric view of an embodiment of an article of footwear 100, also referred to as simply article 100. Article 100 may include upper 101 and sole 102. Upper 101 may include an opening or throat 110 that allows the wearer to insert his or her foot into article 100. In some embodiments, upper 101 may also include laces 111, which can be used to tighten or otherwise adjust upper 101 around a foot. For purposes of illustration, only some provisions of upper 101 are shown, however it will be understood that upper 101 may include additional provisions in various embodiments.

Article 100 has a heel region 103, an instep or midfoot region 104, and a forefoot region 105. These regions may also be applied to components of article 100 and their relative position in relation to article 100. The regions are not intended to demarcate precise areas of footwear. Rather, forefoot region 105, midfoot region 104, and heel region 103 are intended to represent general areas of article 100 to aid in the following discussion.

In different embodiments, sole 102 could comprise one or more components. For example, sole 102 could include an insole, midsole and/or an outsole. In some embodiments, sole 102 may comprise a midsole layer and a distinct outsole. However, in other embodiments, sole 102 could comprise a single component that functions as a midsole and outsole for sole 102. That is, in at least some embodiments, sole 102 may provide both cushioning and traction, as well as possibly other provisions, for article 100. Although not illustrated in the exemplary embodiment, some other embodiments may have a distinct outsole component that could incorporate a tread pattern, or may have cleats, spikes or other ground-engaging protuberances.

Figure 2:
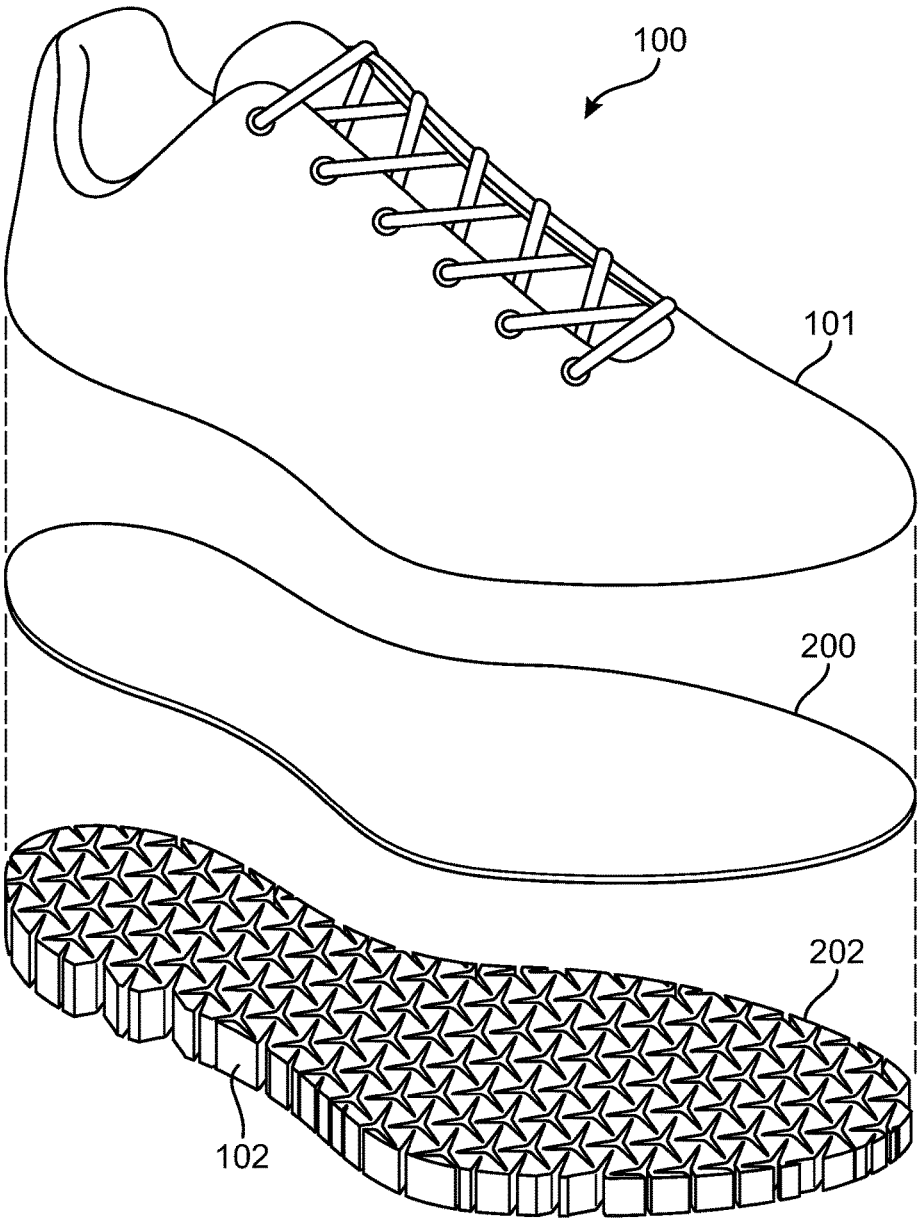
FIG. 2 is an exploded isometric view of an exemplary embodiment of an article of footwear.

FIG. 2 is an exploded side perspective view of an embodiment of article 100. Article 100 may include upper 101, strobel 200, and sole 102. In some embodiments, strobel 200 may be used to secure upper 101 to sole 102. In some embodiments, upper 101 may be secured to strobel 200 before strobel 200 is secured to sole 102. After strobel 200 and upper 101 are attached, the combination of strobel 200 and upper 101 may be attached to sole 102. In some embodiments, attaching upper 101 to strobel 200 may assist in the ease of securing upper 101 to sole 102. That is, because upper 101 is secured to strobel 200, upper 101 may be in a fixed position when attaching strobel 200 to sole 102. Because upper 101 is in a fixed position, the ease in which the attachment of upper 101 to sole 102 occurs may increase. Further, strobel 200 may provide a stable platform to which upper 101 may be attached.

In some embodiments strobel 200 and upper 101 may be mechanically attached. In some embodiments, an adhesive may be used to join strobel 200 and upper 101. In other embodiments, strobel 200 and upper 101 may be stitched together. In other embodiments, strobel 200 and upper 101 may be connected by other techniques.

In some embodiments, strobel 200 may be stiffer than sole 102. In other embodiments sole 102 may be stiffer than strobel 200. Generally the stiffer an element is, the more that element is stretch resistant. Stretch resistance, as used herein, refers to the tendency of an element to resist a force without a change in dimension. That is, the more stretch-resistant an element is, the less that element will change in dimension when subjected to a force. For example, a first element subjected to a first force along a first direction may expand or extend along the first direction a distance 2L. A second element, that is more stretch resistant than the first element, may be subjected to the first force along the first direction may expand or extend along the first direction a distance L. That is, the second element may expand or extend half as much as the first element when subjected to a force of the same magnitude. As such the second element is more stretch-resistant than the first element.

In some embodiments, strobel 200 may be joined to sole 102. In some embodiments, sole 102 and strobel 200 may be mechanically connected. In some embodiments, an adhesive may be used to join strobel 200 and sole 102. In other embodiments, strobel 200 and sole 102 may be stitched together. In other embodiments, sole 102 and strobel 200 may be connected by other techniques.

In different embodiments, the geometry of strobel 200 may vary. For example, strobel 200 may largely align with the shape of an upper surface 202 of sole 102. That is, strobel 200 may completely cover upper surface 202 when attached to sole 102. In other embodiments, strobel 200 may cover some portions, but not necessarily all portions, of upper surface 202. In some embodiments, for example, strobel 200 may cover the perimeter area of upper surface 202 of sole 102.

In some embodiments, strobel 200 may exhibit directional properties. In some embodiments, strobel 200 may be configured to resist stretch in one or more directions. For example, in some embodiments, strobel 200 may exhibit stretch-resistant properties along the width of strobel 200 or the lateral direction. In other embodiments, strobel 200 may exhibit stretch-resistant properties along the length of strobel 200 or the longitudinal direction. In further embodiments, strobel 200 may exhibit stretch-resistant properties in both lateral and longitudinal directions. In still further embodiments, strobel 200 may be stretchable in any direction. Further, strobel 200 may include any combination of the above-mentioned properties. That is, one portion of strobel 200 may exhibit stretch-resistant properties in the lateral direction while another portion of strobel 200 may exhibit stretch-resistant properties in the longitudinal direction. Strobel 200 and various configurations of strobel 200 are discussed later in the detailed description.

The embodiments described herein can make use of any of the apparatus or structures described in Cross et al., U.S. patent application Ser. No. 14/030,002 filed Sep. 18, 2013, patented as U.S. Pat. No. 9,402,439, the entirety of which is hereby incorporated by reference. In Cross et al., many different auxetic structures are discussed with varying thicknesses, material compositions, and geometries relating to sole structures. Further, the embodiments described herein can also make use of apparatus or structures described in Hull, U.S. patent application Ser. No. 13/774,186, filed Feb. 22, 2013, published as U.S. 2014/0237850, the entirety of which is hereby incorporated by reference. In Hull, auxetic material is used in conjunction with inelastic material in the formation of straps.

Figure 3:
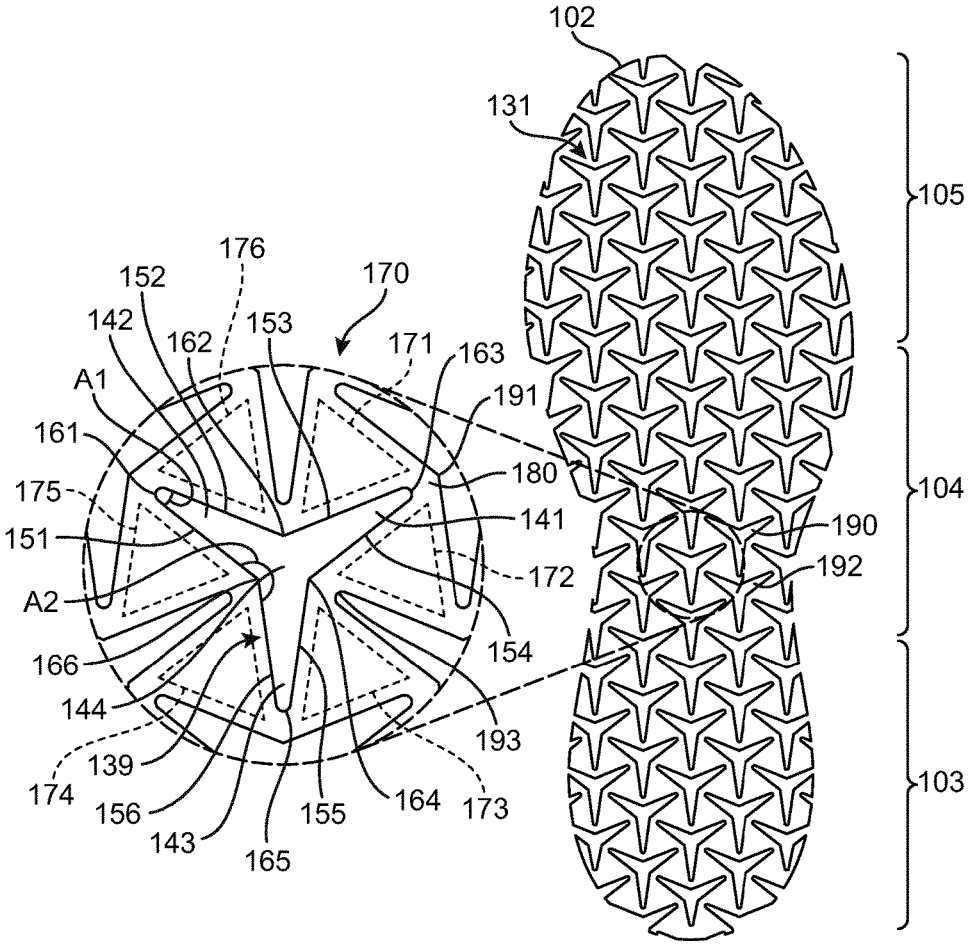
FIG. 3 is a bottom view of an exemplary embodiment of an article of footwear.

FIG. 3 is a bottom view of an embodiment of an article of footwear. FIG. 3 shows the bottom of sole 102. Sole 102 has apertures surrounded by portions that are joined to one another at their vertices. In at least some embodiments, these portions may be polygonal portions or polygonal features that are joined to each other at their vertices. The joints at the vertices function as hinges, allowing the polygonal features to rotate as the sole is placed under tension. This action allows the portion of the sole under tension to expand both in the direction under tension and in the direction in the plane of the sole that is orthogonal to the direction under tension. Thus, these apertures and polygonal features form an auxetic structure for sole 102, which is described in further detail below.

As shown in FIG. 3, sole 102 comprises an approximately flat surface that includes a plurality of apertures 131, also hereafter referred to simply as apertures 131. As an example, an enlarged view of an aperture 139 of apertures 131 is shown schematically within FIG. 3. Aperture 139 is further depicted as having a first portion 141, a second portion 142, and a third portion 143. Each of these portions is joined together at a central portion 144. Similarly, in some embodiments, each of the remaining apertures in apertures 131 may include three portions that are joined together and extend outwardly from a central portion.

Generally, each aperture in plurality of apertures 131 may have any kind of geometry. In some embodiments, an aperture may have a polygonal geometry, including a convex and/or concave polygonal geometry. In such cases, an aperture may be characterized as comprising a particular number of vertices and edges (or sides). In an exemplary embodiment, apertures 131 may be characterized as having six sides and six vertices. For example, aperture 139 is shown as having first side 151, second side 152, third side 153, fourth side 154, fifth side 155, and sixth side 156. Additionally, aperture 139 is shown as having a first vertex 161, second vertex 162, third vertex 163, fourth vertex 164, fifth vertex 165, and sixth vertex 166.

In one embodiment, the shape of aperture 139 (and correspondingly of one or more of apertures 131) may be characterized as a regular polygon, which is both cyclic and equilateral. In some embodiments, the geometry of aperture 139 can be characterized as triangles with sides that, instead of being straight, have an inwardly-pointing vertex at the midpoint of the side. The reentrant angle formed at these inwardly-pointing vertices can range from 180 degrees (when the side is perfectly straight) to, for example, 120 degrees or less.

Other geometries for any apertures in other embodiments are also possible, including a variety of polygonal and/or curved geometries. Exemplary polygonal shapes that may be used with one or more of apertures 131 include, but are not limited to: regular polygonal shapes (e.g., triangular, rectangular, pentagonal, hexagonal, etc.) as well as irregular polygonal shapes or non-polygonal shapes. Other geometries could be described as being quadrilateral, pentagonal, hexagonal, heptagonal, octagonal, or other polygonal shapes with reentrant sides. Still other geometries could comprise apertures with sides that are non-linear or curved. In particular, the shapes of one or more apertures, as well as the corresponding shapes of the material portions of a sole which define the boundaries of the apertures, are not restricted to polygonal geometries and may include any geometries incorporating curved or non-linear sides, sections or other portions.

In the exemplary embodiment, the vertices of an aperture (e.g., aperture 139) may correspond to interior angles that are less than 180 degrees or interior angles that are greater than 180 degrees. For example, with respect to aperture 139, first vertex 161, third vertex 163 and fifth vertex 165 may correspond to interior angles that are less than 180 degrees. In this particular example, each of first vertex 161, third vertex 163 and fifth vertex 165 has an interior angle A1 that is less than 180 degrees. In other words, aperture 139 may have a locally convex geometry at each of these vertices (relative to the outer side of aperture 139). In contrast, second vertex 162, fourth vertex 164 and sixth vertex 166 may correspond to interior angles that are greater than 180 degrees. In other words, aperture 139 may have a locally concave geometry at each of these vertices (relative to the outer side of aperture 139). In this particular example, each of second vertex 162, fourth vertex 164, and sixth vertex 166 may correspond to interior angles that are greater than 180 degrees.

Although the embodiments depict apertures having approximately polygonal geometries, including approximately point-like vertices at which adjoining sides or edges connect, in other embodiments some or all of an aperture could be non-polygonal. In particular, in some cases, the outer edges or sides of some or all of an aperture may not be joined at vertices, but may be continuously curved. Moreover, some embodiments can include apertures having a geometry that includes both straight edges connected via vertices as well as curved or non-linear edges without any points or vertices.

In some embodiments, apertures 131 may be arranged in a regular pattern within sole 102. In some embodiments, apertures 131 may be arranged such that each vertex of an aperture is disposed near the vertex of another aperture (e.g., an adjacent or nearby aperture). More specifically, in some cases, apertures 131 may be arranged such that every vertex that has an interior angle less than 180 degrees is disposed near a vertex that has an interior angle greater than 180 degrees. As one example, third vertex 163 of aperture 139 is disposed near, or adjacent to, a vertex 191 of another aperture 190. Here, vertex 191 is seen to have an interior angle that is greater than 180 degrees, while third vertex 163 has an interior angle that is less than 180 degrees. Similarly, fourth vertex 164 of aperture 139 is disposed near, or adjacent to, a vertex 193 of another aperture 192. Here, vertex 193 is seen to have an interior angle that is less than 180 degrees, while fourth vertex 164 has an interior angle that is greater than 180 degrees.

The configuration resulting from the above arrangement may be seen to divide sole 102 into smaller geometric portions, whose boundaries are defined by the edges of apertures 131. In some embodiments, these geometric portions may be comprised of polygonal portions. For example, in the exemplary embodiment, apertures 131 are arranged in a manner that defines a plurality of polygonal portions 170, also referred to hereafter simply as polygonal portions 170. However, as previously described, the apertures and corresponding portions of sole 102 may not have polygonal geometries in at least some embodiments. Instead, in other embodiments, the edges of each aperture, which also correspond to edges of adjacent portions of sole 102, may be non-linear, curved and/or irregular.

Generally, the geometry of polygonal portions 170 may be defined by the geometry of apertures 131 as well as their arrangement on sole 102. In the exemplary configuration, apertures 131 are shaped and arranged to define a plurality of approximately triangular portions, with boundaries defined by edges of adjacent apertures. Of course, in other embodiments polygonal portions could have any other shape, including rectangular, pentagonal, hexagonal, as well as possibly other kinds of regular and irregular polygonal shapes. Furthermore, it will be understood that in other embodiments, apertures may be arranged on an outsole to define geometric portions that are not necessarily polygonal (e.g., comprised of approximately straight edges joined at vertices). The shapes of geometric portions in other embodiments could vary and could include various rounded, curved, contoured, wavy, nonlinear as well as any other kinds of shapes or shape characteristics.

As seen in FIG. 3, polygonal portions 170 may be arranged in regular geometric patterns around each aperture. For example, aperture 139 is seen to be associated with first polygonal portion 171, second polygonal portion 172, third polygonal portion 173, fourth polygonal portion 174, fifth polygonal portion 175 and sixth polygonal portion 176. Moreover, the approximately even arrangement of these polygonal portions around aperture 139 forms an approximately hexagonal shape that surrounds aperture 139.

In some embodiments, the various vertices of an aperture may function as a hinge. In particular, in some embodiments, adjacent portions of material, including one or more geometric portions (e.g., polygonal portions), may rotate about a hinge portion associated with a vertex of the aperture. As one example, each vertex of aperture 139 is associated with a corresponding hinge portion, which joins adjacent polygonal portions in a rotatable manner.

In the exemplary embodiment, sole portion 102 includes hinge portion 180 (see FIG. 4), which is associated with third vertex 163. Hinge portion 180 is comprised of a relatively small portion of material adjoining first polygonal portion 171 and second polygonal portion 172. First polygonal portion 171 and second polygonal portion 172 may rotate with respect to one another at hinge portion 180. In a similar manner, each of the remaining vertices of aperture 139 is associated with similar hinge portions that join adjacent polygonal portions in a rotatable manner.

Figure 4:
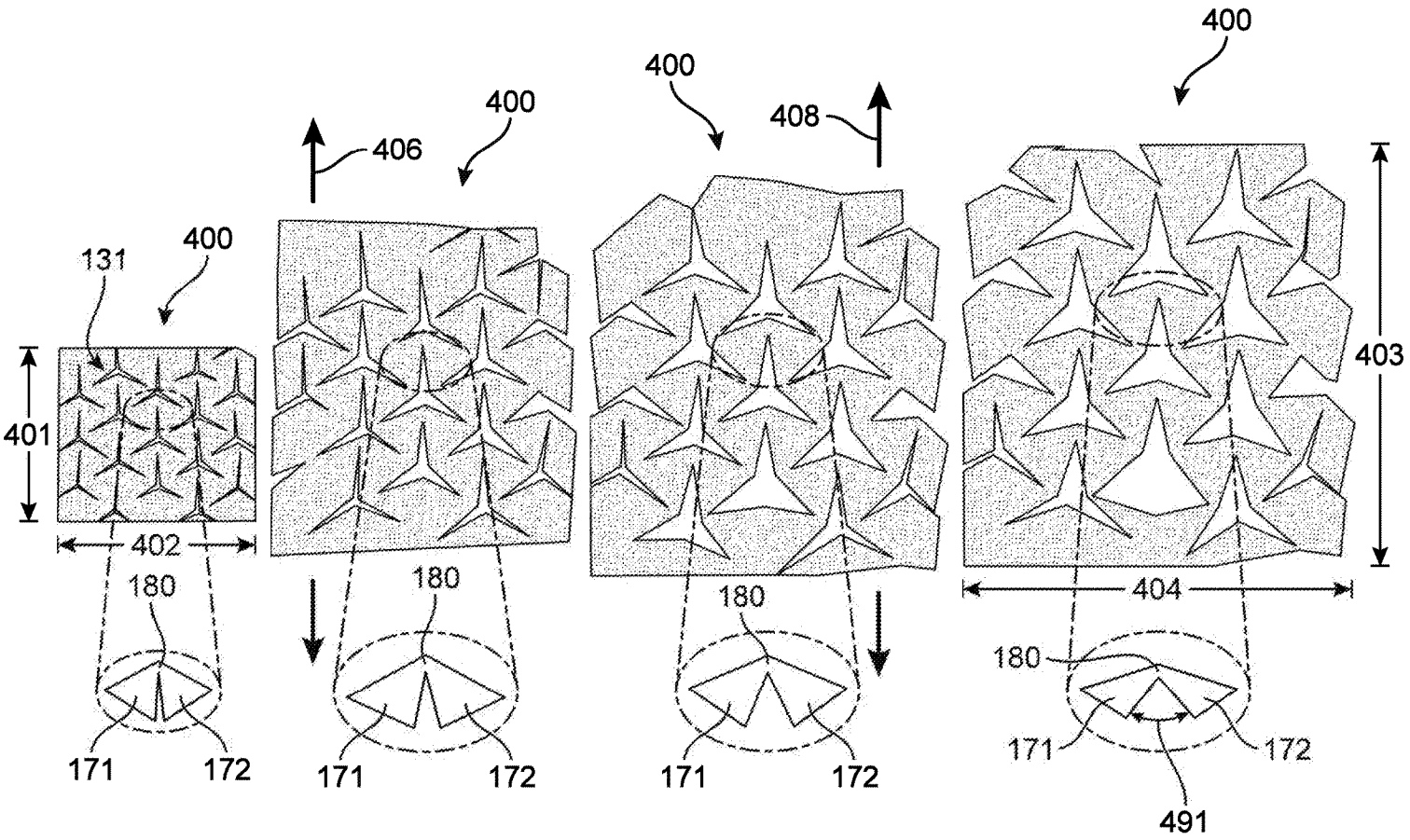
FIG. 4 is a view of an embodiment of a portion of auxetic material being subjected to force.

FIG. 4 illustrates a schematic sequence of configurations for a portion of sole 102 under a tensioning force applied along a single axis or direction. Specifically, FIG. 4 is intended to illustrate how the geometric arrangements of apertures 131 and polygonal portions 170 provide auxetic properties to sole 102, thereby allowing portions of sole 102 to expand in both the direction of applied tension and a direction perpendicular to the direction of applied tension.

As shown in FIG. 4, a portion 400 of sole 102 proceeds through various intermediate configurations as a result of an applied tension in a single linear direction (for example, the longitudinal direction). In particular, the four intermediate configurations may be associated with increasing levels of tension that is applied along a single direction. As shown, force is applied to portion 400 along the longitudinal direction. Force may be directed along arrows 406 and arrows 408. Arrows 406 and arrows 408 are exemplary locations of force. Force applied along other singular linear directions may result in a similar type of expansion as depicted in FIG. 4. For example, force applied along the lateral direction may result in a similar type of expansion. Further, tensional forces along both the lateral direction and the longitudinal direction may also result in a similar type of expansion.

Portion 400 may be resilient or stretch-resistant. In some embodiments, portion 400 may have a stretch-resistance. That is, when tension is released from portion 400, portion 400 may revert to its untensioned state. Further, a certain amount of force may be required to expand or stretch portion 400. In some embodiments, a rigid material may be used to make portion 400. In other embodiments, a stretchable material may be used to make portion 400. In still further embodiments, a combination of rigid material and stretchable material may be used to create portion 400.

Due to the specific geometric configuration for polygonal portions 170 and their attachment via hinge portions, this linear tension is transformed into rotation of adjacent polygonal portions 170. For example, first polygonal portion 171 and second polygonal portion 172 are rotated at hinge portion 180. All of the remaining polygonal portions 170 are likewise rotated as apertures 131 expand. Thus, the relative spacing between adjacent polygonal portions 170 increases. For example, as seen clearly in FIG. 4, the relative spacing between first polygonal portion 171 and second polygonal portion 172 (and thus the size of first portion 141 of aperture 131) increases with increased tension.

As the increase in relative spacing occurs in all directions (due to the symmetry of the original geometric pattern of apertures), the expansion of portion 400 along a first direction as well as along a second direction orthogonal to the first direction results. For example, in the exemplary embodiment, in the initial or non-tensioned configuration (seen on the left in FIG. 4), portion 400 initially has an initial size 401 along a first linear direction (e.g., the longitudinal direction) and an initial size 402 a second linear direction that is orthogonal to the first direction (e.g., the lateral direction). In the fully expanded configuration (seen on the right in FIG. 4), portion 400 has an final size 403 in the first linear direction and an final size 404 in the second linear direction. In other words, final size 403 is greater than initial size 401 and final size 404 is greater than initial size 402. Thus, it is clear that the expansion of portion 400 is not limited to expansion in the tensioning direction. Moreover, in some embodiments, the amount of expansion (e.g., the ratio of the final size to the initial size) may be approximately similar between the first direction and the second direction. In other words, in some cases, portion 400 may expand by the same relative amount in, for example, both the longitudinal direction and the lateral direction. In contrast, some other kinds of structures and/or materials may contract in directions orthogonal to the direction of applied tension.

In the exemplary embodiments shown in the Figures, an auxetic structure, including sole comprised of an auxetic structure may be tensioned in the longitudinal direction or the lateral direction. However, the arrangement discussed here for auxetic structures comprised of apertures surrounded by geometric portions provides a structure that can expand along any first direction along which tension is applied, as well as along a second direction that is orthogonal to the first direction. Moreover, it should be understood that the directions of expansion, namely the first direction and the second direction, may generally be tangential to a surface of the auxetic structure. In particular, the auxetic structures discussed here may generally not expand substantially in a vertical direction that is associated with a thickness of the auxetic structure. However, in some other embodiments, an auxetic structure could be configured to expand in two directions that are orthogonal to an original tensioned direction. In other words, in some embodiments, auxetic structures could be configured to that applying tension along a first direction results in expansion of the auxetic structure along three approximately orthogonal directions.

Some embodiments may include provisions for controlling the expansion, compression, and/or other movements of one or more portions of an auxetic structure. In some embodiments, an article can include a component that interacts with the auxetic structure to control the expansion of the auxetic structure. In some embodiments, the article may include an overlay that interfaces with at least a portion of the auxetic structure. Furthermore, in some embodiments, the overlay may be configured to have stretch-resistant properties along at least one direction of the auxetic structure so as to restrain or otherwise modify expansion of the auxetic structure in at least one direction. Referring to FIGS. 5-12, portion 400 is examined in conjunction with a material overlay.

Figure 5:
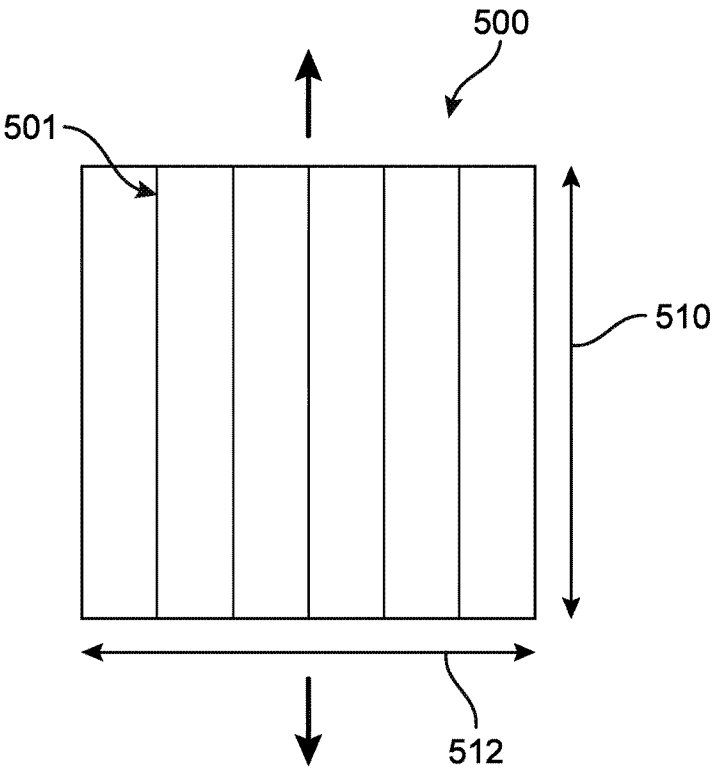

FIG. 5 illustrates a schematic view of an overlay 500. Overly 500 as depicted may be formed of a material that is stretch-resistant in the longitudinal or lengthwise direction. In the exemplary embodiment, overlay 500 may include elements 501 that help control stretch along at least one direction. As depicted, elements 501 align with the direction of overlay 500 that is stretch-resistant. That is, elements 501 are located along the longitudinal or lengthwise direction. Elements 501 may be comprised of stretch-resistant material, or may represent a certain stretch-resistant stitch. Elements 501 are utilized in the Figures to more specifically illustrate the nature of stretch of overlay 500, however, the composition, make-up, or orientation of elements 501 may be altered in different embodiments.

Figure 6:
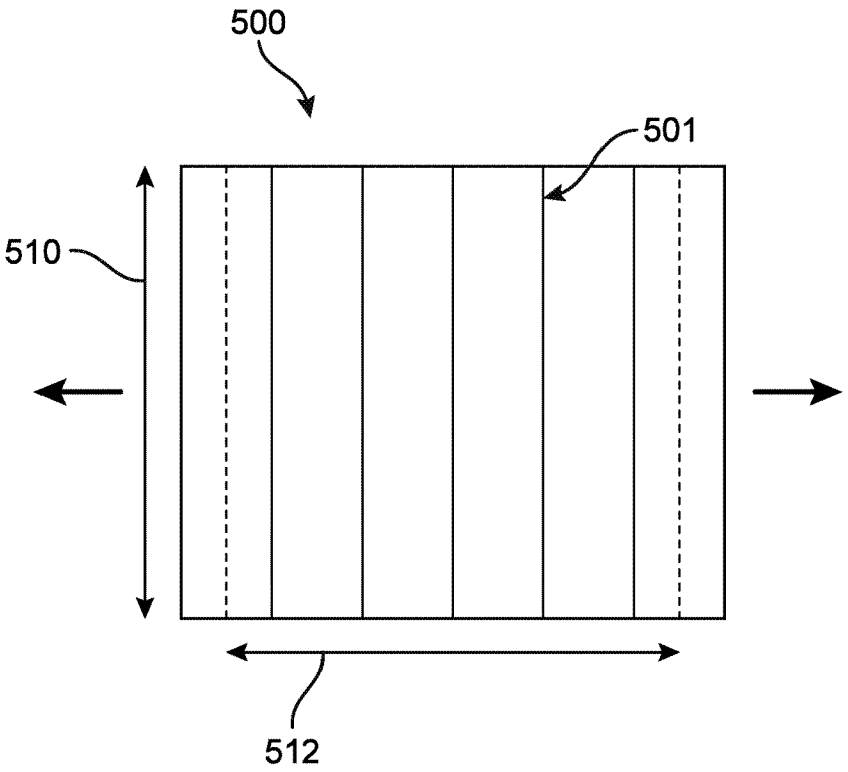
FIGS. 5-6 depict an embodiment of an overlay subjected to force.

Referring to FIGS. 5-6, overlay 500 is subjected to force along two different directions. In FIG. 5, overlay 500 is subjected to force along longitudinal direction 510. Because the force is along the same direction as stretch-resistant elements 501, overlay 500 may remain substantially the same dimension (e.g., overlay 500 may not expand under tension applied along longitudinal direction 510). Specifically, elements 501 may counteract the force and allow overlay 500 to remain substantially unchanged. In FIG. 6, however, overlay 500 is subjected to force along lateral direction 512. Because the force is along a direction orthogonal to stretch-resistant elements 501, overlay 500 may stretch along lateral direction 512. Further, as depicted, overlay 501 does not include additional means for resisting stretch along lateral direction 512. In other embodiments, overlay 500 may include other provisions for limiting stretch in different directions.

Figure 7:
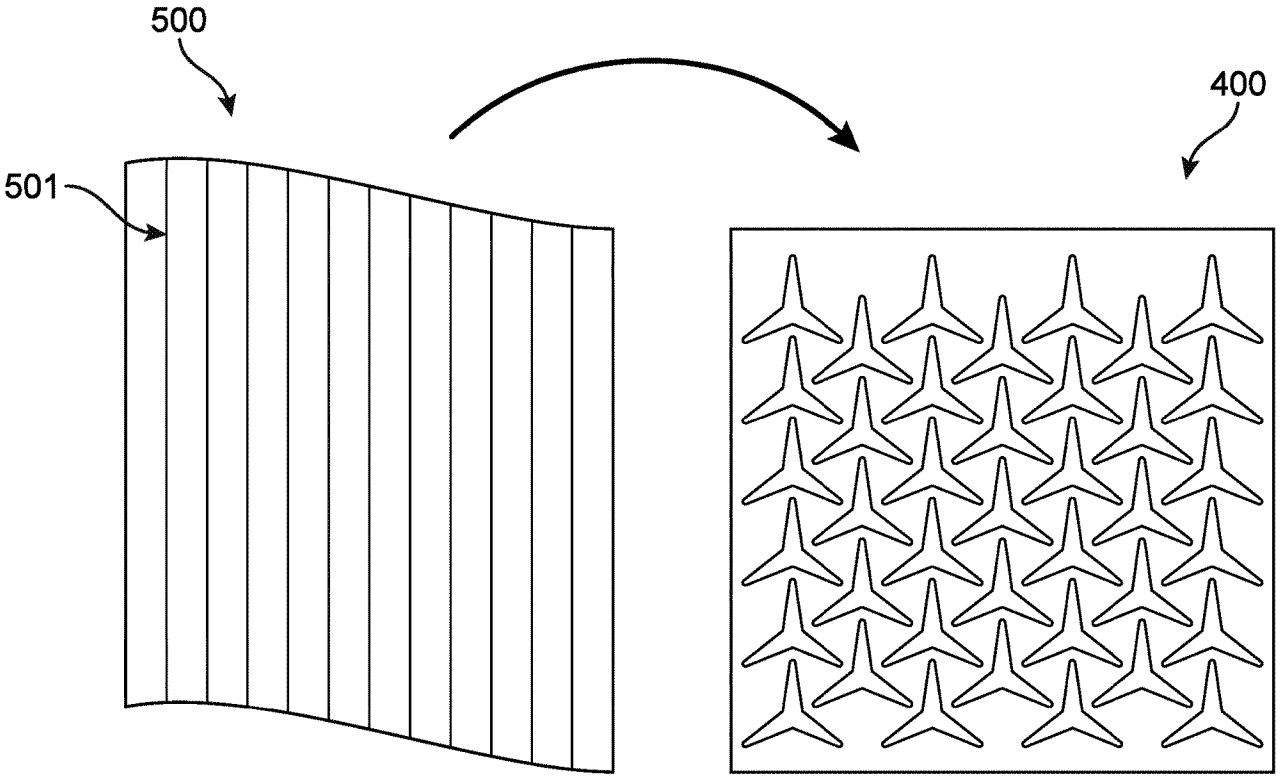
FIG. 7 is a view of an embodiment of a portion of auxetic material and an overlay material.

FIG. 7 depicts an overlay 500 being placed onto portion 400. As discussed above, overlay 500 may be used to control the movement of auxetic structures. In particular, overlay 500 may be used to control the movement of portion 400.

Figure 8:
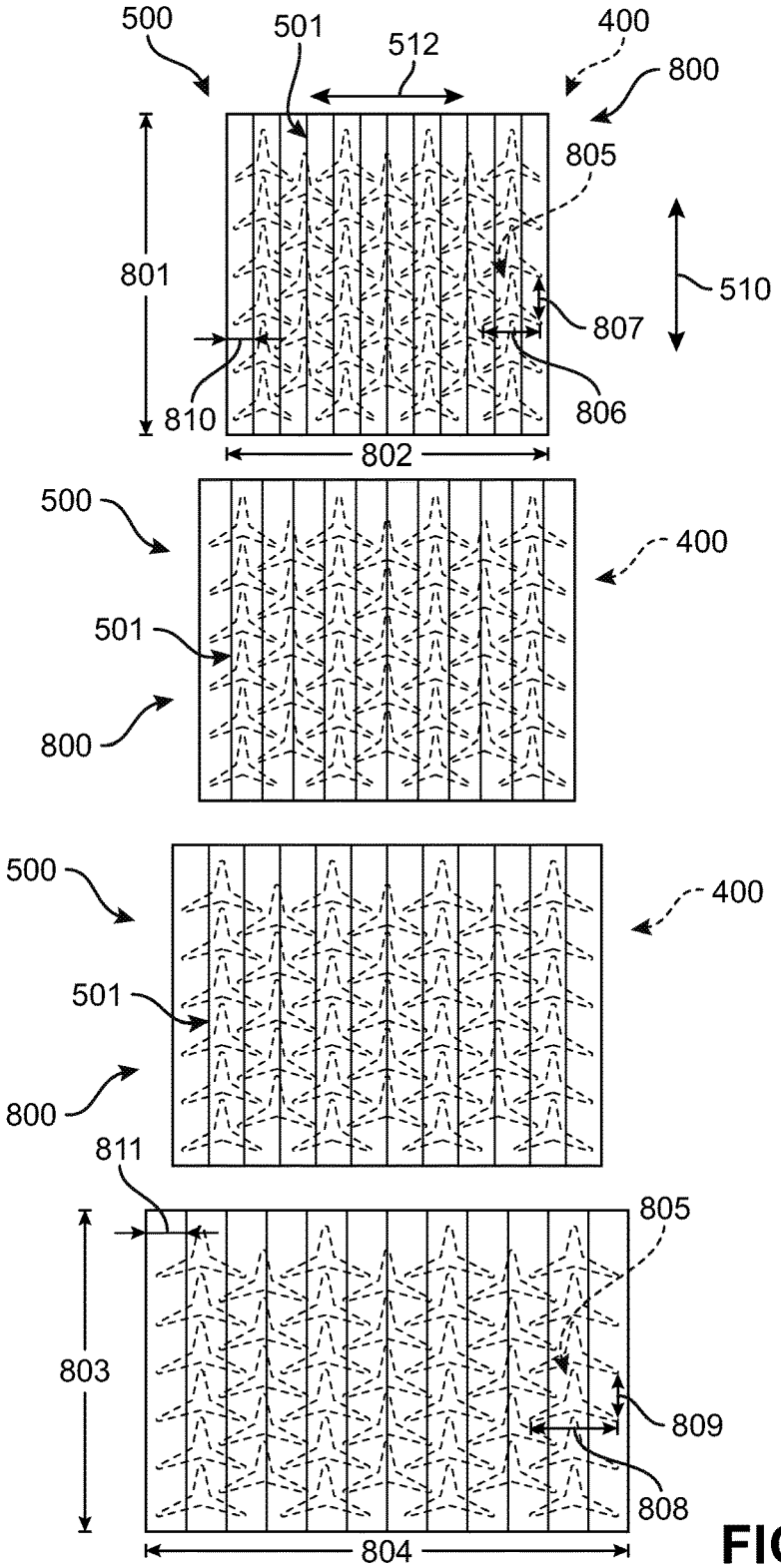
FIG. 8 is a view of an embodiment of a portion of auxetic material and an overlay material being subjected to force.

FIG. 8 illustrates a sequence of configurations of portion 400 expanding while overlay 500 is attached to portion 400. For purposes of illustration, portion 400 is shown in phantom, as portion 400 may be disposed beneath overlay 500 in the views shown in FIG. 8.

Referring to FIG. 8, overlay 500 may be attached or joined to portion 400. Overlay 500 may be attached to portion 400 using mechanical techniques. In some embodiments, overlay 500 may be attached to portion 400 using an adhesive. In other embodiments, overlay 500 may be stitched to portion 400. In still further embodiments, overlay 500 may be heat-bonded to portion 400. In other embodiments, overlay 500 may be joined to portion 400 using a fastener, such as a tack. The combination of overlay 500 and portion 400 is referred to as stretch-resistant structure 800.

The four depictions in FIG. 8 of stretch-resistant structure 800 show stretch-resistant structure 800 in different stages of expansion when exposed to a force along lateral direction 512. The first depiction illustrates initial size 801 along the longitudinal direction 510 of stretch-resistant structure 800. Initial size 802 is along lateral direction 512 of stretch-resistant structure 800. As stretch-resistant structure 800 is placed under tension along lateral direction 512, stretch-resistant structure 800 extends along lateral direction 512. As depicted, initial size 802 along lateral direction 512 is smaller than final size 804 along lateral direction 512 of stretch-resistant structure 800. Stretch-resistant structure 800 may extend to a lesser extent, however, along longitudinal direction 510. Final size 803 may be substantially similar to initial size 801. The difference in length between initial size 801 and final size 803 may be minimal. This is in contrast to portion 400 as shown in FIG. 4, where no overlay was used to restrict expansion of portion 400. The difference in length between initial size 801 and final size 803 therefore is less than the difference in length between initial size 401 and final size 403.

Stretch-Resistant structure 800 may extend to a lesser degree along longitudinal direction 510 when exposed to tensile force than portion 400 of FIG. 4 due to the presence of overlay 500. As depicted in FIG. 8, as stretch-resistant structure 800 is exposed to a tensile force along lateral direction 512, overlay 500 may extend along lateral direction 512. As shown, the space between elements 501 may increase as stretch-resistant structure 800 is stretched widthwise. For example, space 811 in the last depiction of structure 800 may be greater than space 810 of structure 800 before structure 800 has been subjected to a force. This is due to the force pulling elements 501 away from one another. The dimension of overlay 500 remains substantially unchanged however, along longitudinal direction 510. Due to the properties of overlay 500, initial size 801 and final size 803 of stretch-resistant structure 800 may be substantially the same. The longitudinally stretch-resistant overlay 500 may therefore restrict the motion of portion 400 to which overlay 500 is attached.

The action of overlay 500 in restricting the expansion of portion 400 may be further understood as limiting the degree to which two adjacent elements in portion 400, which are connected by a hinge portion, may rotate. As a specific example, whereas in the absence of overlay 500, a first portion 171 and a second portion 172 of portion 400 (see FIG. 4) may tend to rotate away from one another as tension is applied to portion 400, the use of overlay 500 with portion 400 may act to limit or otherwise restrict the relative rotation between first portion 171 and second portion 172. In other words, if the first portion 171 and second portion 172 are rotated to a first angle (e.g., angle 491 in FIG. 4) without overlay portion 500, then first portion 171 and second portion 172 will rotate to a second angle that is substantially less than the first angle when overlay 500 is used to restrict the auxetic expansion of portion 400. The difference between the first angle and the second angle (i.e., the degree to which rotation is restricted by the use of overlay 500) will vary with the properties of overlay 500 and in particular the amount of stretch resistance provided by overlay 500.

While overlay 500 may restrict the motion or extension of portion 400 in the longitudinal direction, overlay 500 may permit portion 400 to extend along lateral direction 512. The apertures of portion 400 may extend in the lateral direction while remaining substantially the same size in the longitudinal direction. For example, aperture 805 has a first width 806 and a first length 807. As stretch-resistant structure 800 is subjected to tensile force along the lateral direction the width of aperture 805 may increase from first width 806 to second width 808. As shown, the triangular-shaped aperture 805 may resemble a more squat, or flattened triangle when subjected to tensile force than when in an unaltered state. First length 807 may be substantially the same as second length 809. The change in shape of aperture 805 may be typical of portion 400 within stretch-resistant structure 800 thereby increasing the width of stretch-resistant structure 800 while minimally affecting the length of stretch-resistant structure 800.

Referring to FIGS. 9-12, overlay 900 as depicted may be formed of a material that is stretch-resistant in the lateral or widthwise direction. As depicted, elements 901 align with the direction of overlay 900 that is stretch-resistant. That is, elements 901 are located along the lateral or widthwise direction. Elements 901 may be composed of stretch-resistant material, or may represent a certain stretch-resistant stitch. Elements 901 are utilized in the Figures to more specifically illustrate the nature of stretch of overlay 900, however, the composition, make-up, or orientation of elements 901 may be altered in different embodiments.

Figure 10:
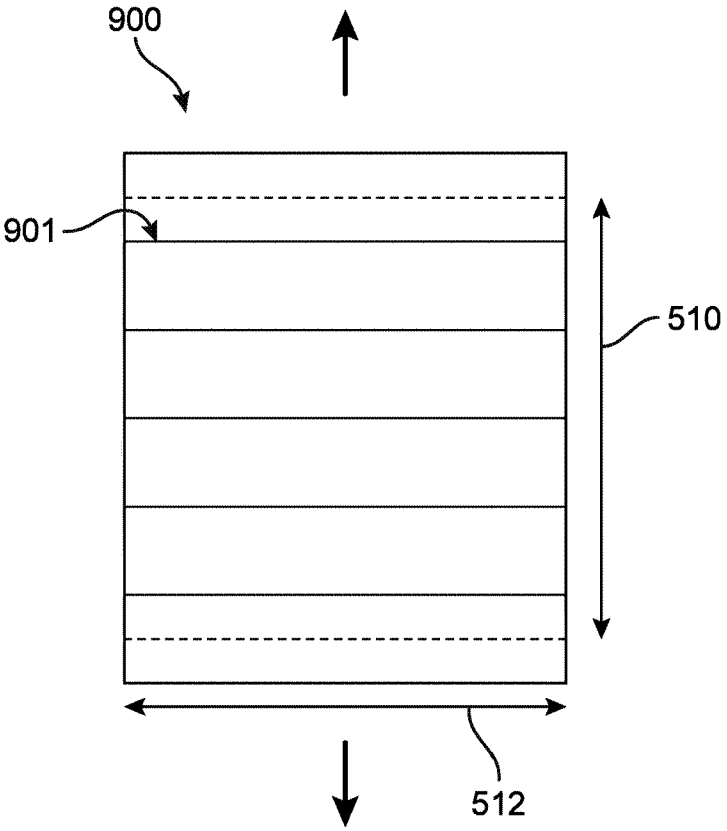
FIGS. 9-10 depict an embodiment of an overlay subjected to force.
Figure 9:
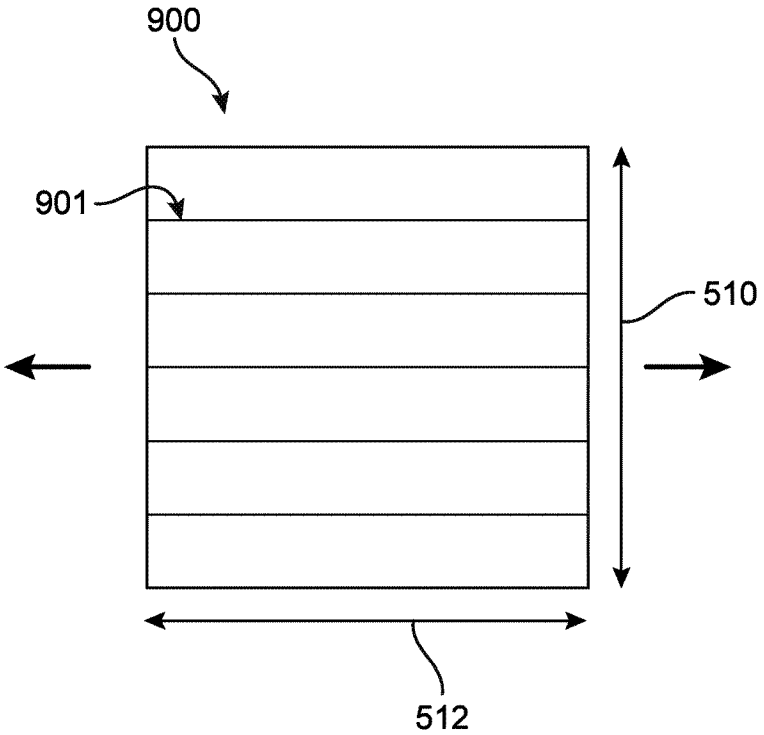

Referring specifically to FIGS. 9-10 overlay 900 is subjected to force along two different directions. In FIG. 9, overlay 900 is subjected to force along lateral direction 512. Because the force is along the same direction as stretch-resistant elements 901, overlay 900 may remain substantially the same dimension. Elements 901 may counteract the force and allow overlay 900 to remain substantially unchanged. In FIG. 10, overlay 900 is subjected to force along longitudinal direction 510. Because the force is along a direction orthogonal to stretch-resistant elements 901, overlay 900 may stretch along longitudinal direction 510. Further, as depicted, overlay 901 does not include additional means for resisting stretch along longitudinal direction 510. In other embodiments, overlay 900 may include other provisions for limiting stretch in different directions.

Figure 11:
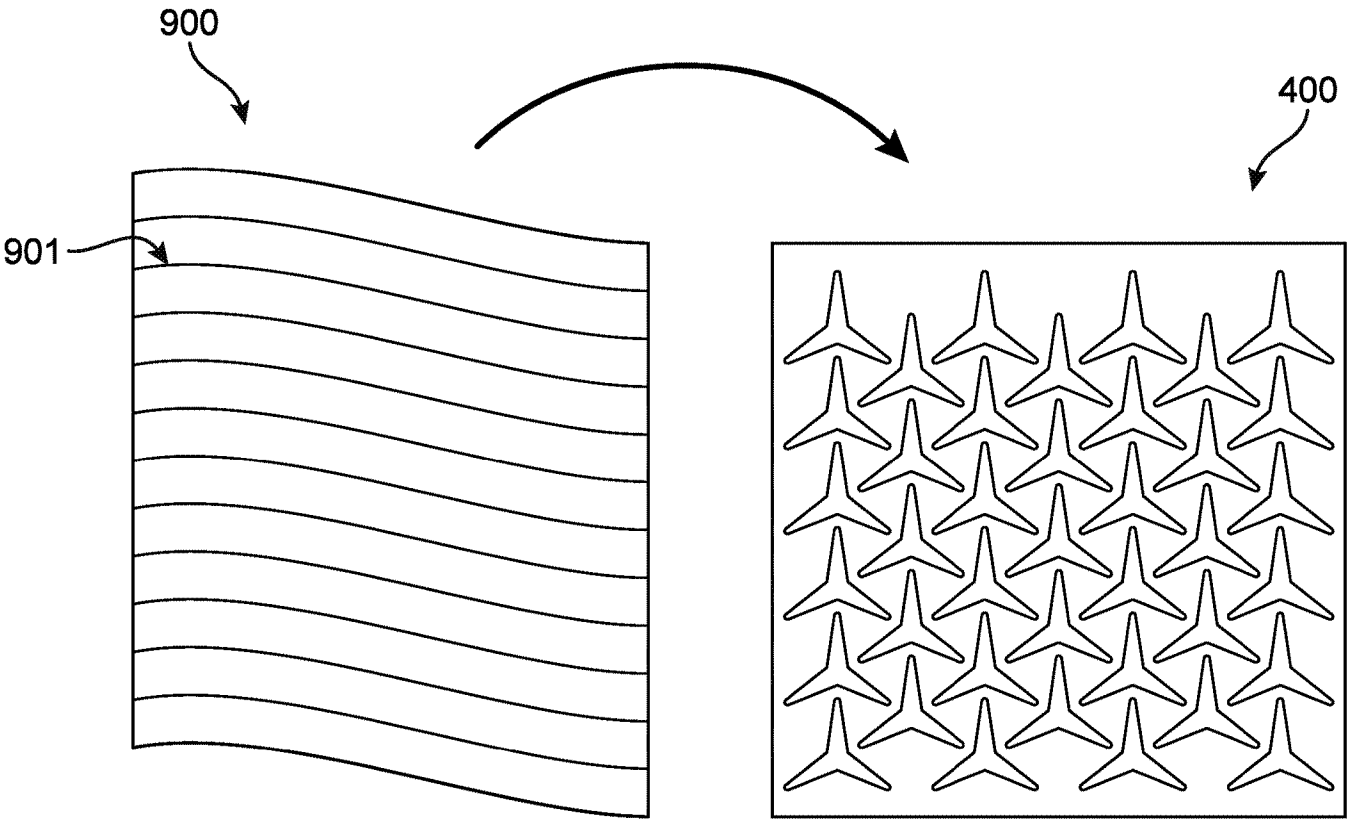
FIG. 11 is a view of an embodiment of a portion of auxetic material and an overlay material.

FIG. 11 depicts an overlay 900 being placed onto portion 400. As discussed above, overlay 900 may be used to control the movement of auxetic structures. In particular, overlay 900 may be used to control the movement, including the expansion, of portion 400.

Figure 12:
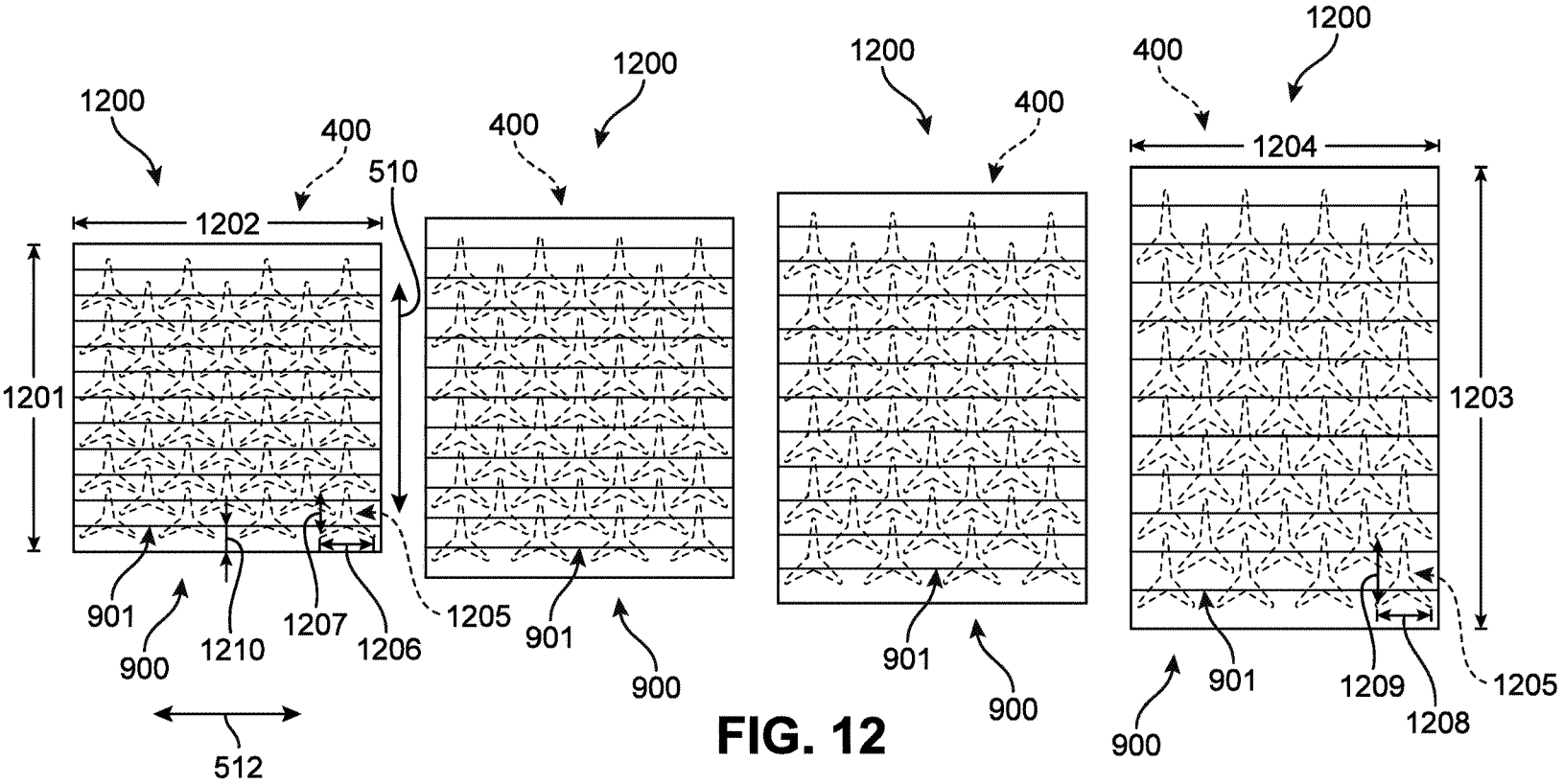
FIG. 12 is a view of an embodiment of a portion of auxetic material and an overlay material being subjected to force.

FIG. 12 illustrates a sequence of configurations of portion 400 expanding while overlay 900 is attached to portion 400. For purposes of illustration, portion 400 is shown in phantom, as portion 400 may be disposed beneath overlay 900 in the views shown in FIG. 12.

Referring to FIG. 12, overlay 900 may be attached or joined to portion 400. Overlay 900 may be attached to portion 400 using mechanical techniques as discussed in relation to overlay 500 in FIG. 8. The combination of overlay 900 and portion 400 is referred to as stretch-resistant structure 1200.

The four depictions in FIG. 12 of stretch-resistant structure 1200 show stretch-resistant structure 1200 in different stages of expansion when exposed to a force along longitudinal direction 510. The first depiction illustrates initial size 1201 along longitudinal direction 510 of stretch-resistant structure 1200. Initial size 1202 is along lateral direction 512 of stretch-resistant structure 1200. As stretch-resistant structure 1200 is placed under tension along longitudinal direction 510, stretch-resistant structure 1200 extends along longitudinal direction 510. As depicted, initial size 1201 along longitudinal direction 510 is smaller or shorter than final size 1203 along longitudinal direction 510 of stretch-resistant structure 1200. Stretch-resistant structure 1200 may extend to a lesser extent, however, along lateral direction 512. The difference in length between initial size 1202 and final size 1204 may be minimal. This is in contrast to portion 400 as shown in FIG. 4, where no overlay was used to restrict expansion of portion 400. The difference in length between initial size 1202 and final size 1204, therefore is less than the difference in length between initial size 401 and final size 403.

Stretch-Resistant structure 1200 may extend to a lesser degree in along lateral direction 512 when exposed to tensile force than portion 400 of FIG. 4 due to the presence of overlay 900. As depicted in FIG. 12, as stretch-resistant structure 1200 is exposed to a tensile force along the longitudinal or lengthwise direction, overlay 900 may extend along lateral direction 512. As shown, the space between elements 901 may increase as stretch-resistant structure 800 is stretched lengthwise. For example, space 1211 in the last depiction of structure 800 may be greater than space 1210 of structure 1200 before structure 1200 has been subjected to a force. This is due to the force pulling elements 901 away from one another. The dimension of overlay 900 remains substantially unchanged however, along lateral direction 512. Due to the properties of overlay 901, initial size 1202 and final size 1204 of stretch-resistant structure 1200 may be substantially the same. The laterally stretch-resistant overlay 900 may therefore restrict the motion of portion 400 to which overlay 900 is attached.

While overlay 900 may restrict the motion or extension of portion 400 in the lateral direction, overlay 900 may permit portion 400 to extend along longitudinal direction 510. The apertures of portion 400 may extend along longitudinal direction 510 while remaining substantially the same size along lateral direction 512. For example, aperture 1205 has a first width 1206 and a first length 1207. As stretch-resistant structure 1200 is subjected to tensile force along the longitudinal direction the length of aperture 1205 may increase from first length 1207 to second length 1209. As shown, the triangular shaped aperture 1205 may resemble a more elongated triangle when subjected to tensile force than when in an unaltered state. First width 1206 may be substantially the same as second width 1208. The change in shape of aperture 1205 may be typical of portion 400 within stretch-resistant structure 1200 thereby increasing the length of stretch-resistant structure 1200 while minimally affecting the width of stretch-resistant structure 1200.

As discussed with reference to FIGS. 5-12, an overlay may be used to inhibit the stretch of an auxetic structure in different directions. In some embodiments, the effects and nature of an auxetic structure may be desirable after and therefore left uninhibited. In other embodiments, however, auxetic structures may be inhibited along different directions for purposes of support, style, comfort and other purposes. The use of directionally stretch-resistant auxetic structures is now discussed in detail with respect to article of footwear.

Figure 13:
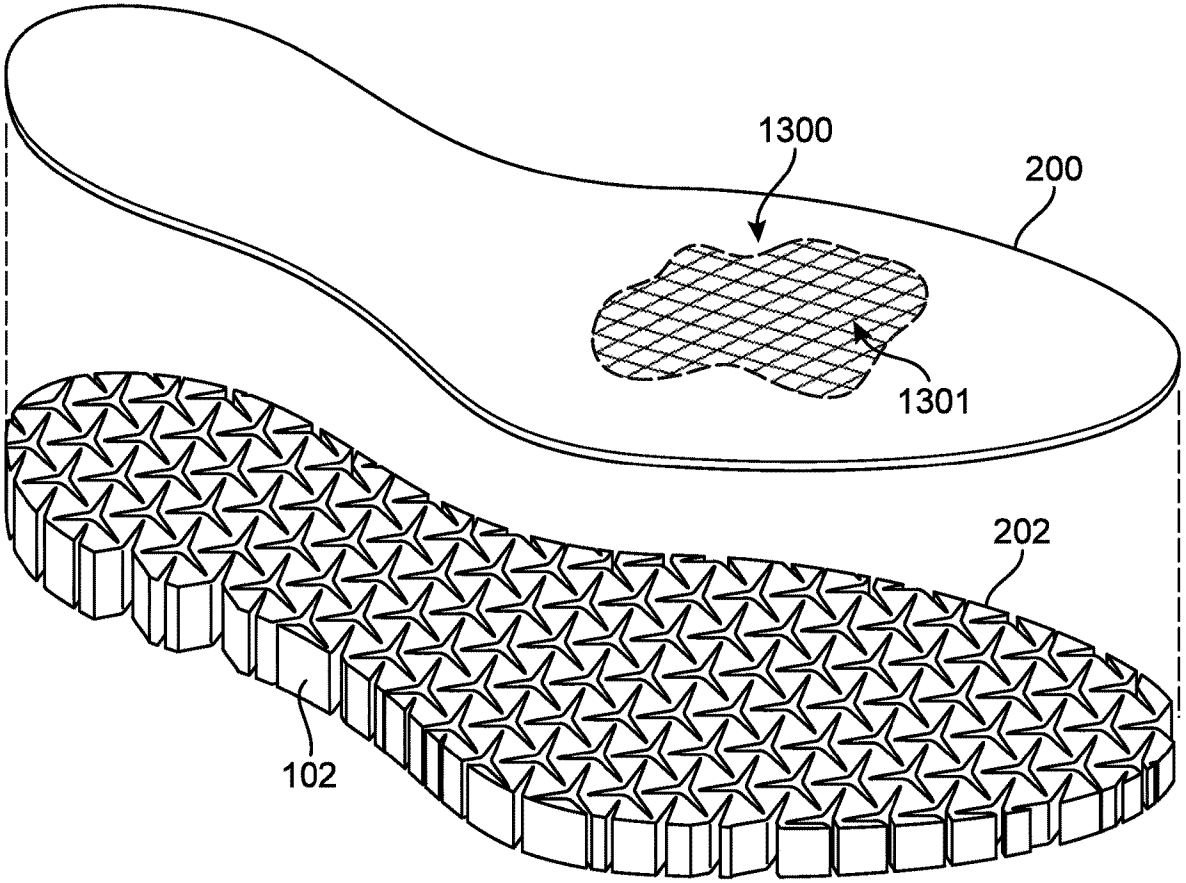
FIG. 13 is an exploded isometric view of an embodiment of a strobel structure.
Figure 14:
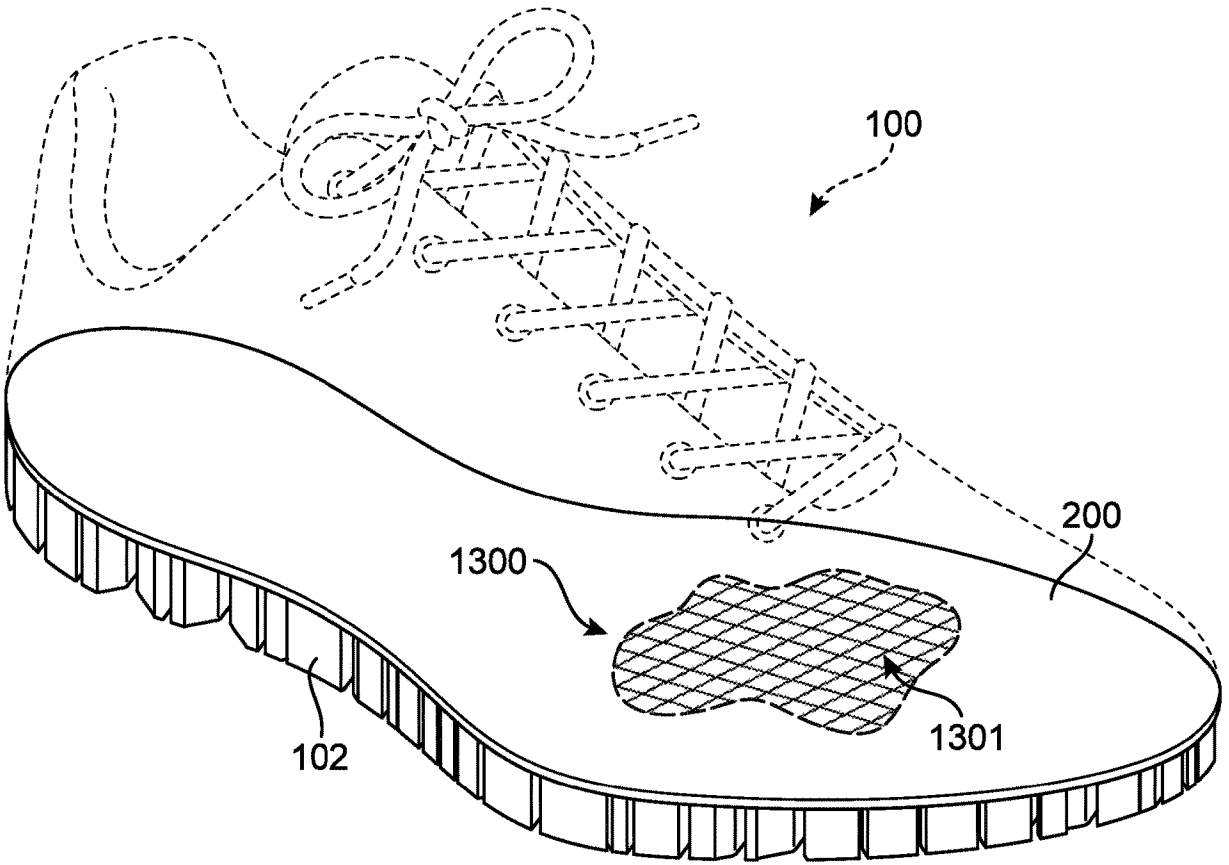
FIG. 14 is an isometric view of an embodiment of an article of footwear.
Figure 15:
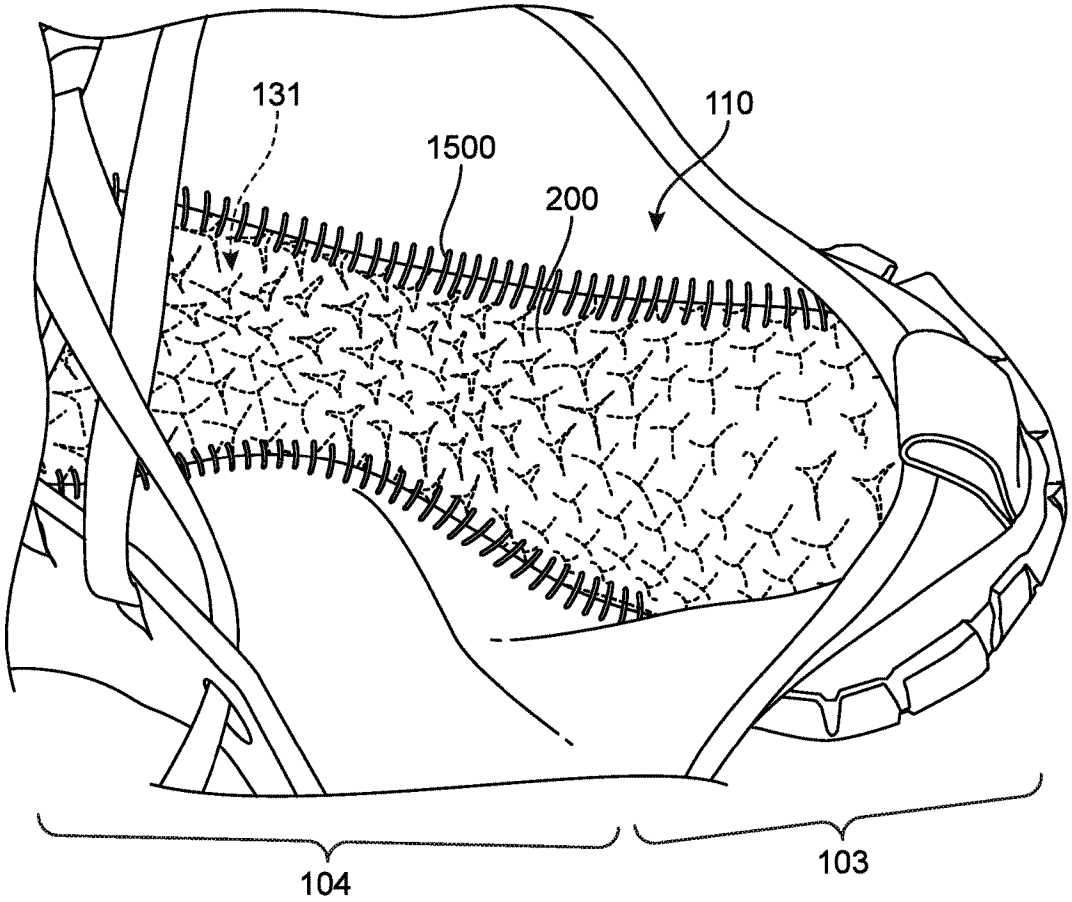
FIG. 15 is a top view of an embodiment of the heel region of an article of footwear.

FIGS. 13-15 illustrate a strobel attached to sole 102 of article of footwear 100. As depicted, strobel 200 may be attached to sole 102. Strobel 200 may have stretch-resistant properties in the length and width directions of strobel 200. A portion of strobel 200, swatch 1300, illustrates the material used to create strobel 200. Swatch 1300 includes elements 1301 which are oriented in the lengthwise and widthwise direction with respect to strobel 200. Similarly to elements 501 and elements 901, the direction in which elements 1301 are oriented indicates the direction in which the material that is used to create strobel 200 resists stretch. As such, swatch 1300 illustrates a material configuration of strobel 200 that may resist stretch along the lengthwise and widthwise directions. In some embodiments, the auxetic nature of sole 102 may be limited by a material of the configuration above to control the stretch of the auxetic sole 102, while retaining the look and some aspects of the feel and comfort that sole 102 may provide. While swatch 1300 is shown to be located in the forefoot region 105, it should be recognized that the construction of swatch 1300 may be located throughout strobel 200.

In some embodiments, strobel 200 may be associated with the entirety of upper surface 202 of sole 102. Upper surface 202 is described as the surface of sole 102 opposite the surface that contacts the ground or contact area. In some embodiments, discussed later in the description, strobel 200 may be associated with only some, but not all, portions of upper surface 202 such that portions of sole 102 may not be directly inhibited in movement by strobel 200. That is, at least some portions of sole 102 may not be attached to strobel 200. As shown in the exemplary embodiment of FIG. 13, strobel 200 is associated with the entire upper surface 202 of sole 102.

FIG. 15 depicts a top view of a portion of article 100. Heel region 103 and midfoot region 104 of article 100 are shown through throat 110 of article 100.

Strobel 200 may be secured to upper 101 and sole 102. Strobel 200 may be joined to sole 102 and/or upper 101 by different techniques including adhesives, stitching, thermoplastic bonding and others. As depicted strobel 200 is stitched to upper 101 with stitches 1500. In some embodiments, portions of strobel may be attached to sole. That is, although strobel 200 may cover upper surface 202 of sole 102, the entirety of strobel 200 may not be secured to sole 102.

The locations of apertures 131 may be shown as phantom or dotted lines in the depiction of FIG. 15. As shown in the embodiment of FIG. 15, strobel 200 therefore covers sole 102. Although FIG. 15 depicts a particular configuration and orientation for apertures 131, the orientation of apertures 131 shown in FIG. 15 may change as a user walks or bends article of footwear 100.

FIGS. 16-33 depict various embodiments of a strobel and sole combination. The strobels shown may have different shapes, compositions, and material properties. Each of the embodiments discussed below may include material properties as discussed above. In some cases, particular reference to the material properties may be mentioned in discussion of the different embodiments in FIGS. 16-33. While a particular material property may be mentioned in relation to a particular embodiment, it should be recognized that the material properties are not limited to the particular embodiment with which the material property is mentioned.

In different embodiments, the strobel may exhibit multiple different properties. In some embodiments, the strobel may be rigid. In other embodiments, the strobel may be flexible. In some embodiments, the strobel may exhibit different properties in the lateral direction than the longitudinal direction. For example, a strobel may be manufactured such that the strobel has elasticity or stretchability in the lateral direction and has little or no elasticity or stretchability in the longitudinal direction. Further, a strobel may be stretchable or flexible in all directions, or inflexible in all directions.

In some embodiments, the strobel properties may be created using a particular knit structure. In some embodiments, a particular stitch may be utilized that is stretch resistant in one direction, and stretchable in the other direction. In some embodiments, a knit stitch may be oriented such that the stretch resistant properties of the knit stitch may be realized within the strobel.

A strobel may be created using different material types. For example a strobel may be created from non-wovens, knit, woven materials, or a combination thereof. The different material types may be utilized for comfort, style, and versatility, among other aspects. Further, distinct areas of a strobel may use different types of materials in order to impart specific properties in specific areas.

Each different material type may further utilize different material components. In some embodiments, a single material may be utilized. In other embodiments, multiple material types may be utilized. For example, some materials may be comprised of natural fibers, such as cotton. Others may be comprised of synthetic materials, such as polyester. Further, the strobel material may be created from plastics. In some embodiments, thermoplastic yarn may be utilized. A combination thereof of different material types may also be used to create a distinct material type.

In some embodiments, the thickness of the strobel material may be changed in order to influence the properties of the strobel. For example, a thin layer of material may be used to allow for stretchability, while a thicker layer of the same material may be used for increased stretch-resistance. Also, a material may be layered to impart different properties in different areas. For example, a double layer of material may be used in one area in order to strengthen a particular property within that area. The thickness of the strobel may therefore be altered throughout the strobel to achieve specific properties at certain areas.

Further, a material that includes stretch-resistant properties in one direction may be layered in different orientations. By layering the same stretch-resistant material in different directions the desired properties may be realized in various directions. For example, a material with stretch-resistant properties in the lateral direction (or at 180 degrees) may be a first layer. A second layer of the same material may be rotated by a degree (for example, forty-five degrees) and layered on top of the first layer. The resulting material may have stretch-resistant properties in the forty-five degree orientation as well as the 180 degree orientation.

Each strobel may be exposed to various property-changing techniques. For example, a strobel with thermoplastic yarn may be exposed to heat in order to fuse the yarn in a specific location or orientation. Further, an article may be spot welded in order to impart specific properties along the strobel.

A strobel further may be a discrete component from the upper. In some embodiments, strobel may be attached to upper by mechanical techniques in a separate step from the creation of upper. In other embodiments, however, the upper may be created such that strobel is integrally formed into the upper. In such cases, the upper may wrap above and below a foot. The upper may therefore act as a strobel in such circumstances and may be adhered to a sole in a similar manner as is discussed pertaining to a strobel.

Generally, an upper may be attached to a strobel or a sole around or near the perimeter of a sole. A foot may be inserted and press against the upper. As a user walks or moves, force may be transferred to the upper, sole, and/or strobel. In some embodiments, a resilient connection point to the upper may be desired. As force is exerted on the upper the force may transfer to the strobel and then transfer to the sole. In some embodiments, the force may cause the sole or strobel to deform or bend. Because the force may cause the strobel or sole to bend, a stable connection to limit the deformation may be utilized in the form of a perimeter strobel attached to sole. The strobel may create a stable connection point from the upper to the strobel. This may allow for the outsole to remain in the same or similar shape when subjected to force, thereby providing support to the user.

A strobel structure may experience tensile forces due to a cutting action while an article of footwear is in use. A strobel with stretch-resistant properties in multiple directions may seek to limit the stretch of a sole while retaining some of the features of an auxetic sole. For example, an auxetic sole may provide for increased comfort and feel even when largely restrained from translating and moving by a restrictive strobel in an outward (e.g., longitudinal and/or lateral) direction. In some cases, this is accomplished through bending of the auxetic sole. Although the auxetic sole may be restricted from translating along the lateral and longitudinal directions, the auxetic sole may still move in the vertical direction. As the auxetic structure moves in the vertical direction portions of the auxetic sole that are not restricted by the strobel (e.g. the ground-contacting portions), may still expand due to the auxetic nature.

Further, an auxetic sole with a restrictive strobel may expand during a cutting motion. For example, if a user changes direction while the ground-contacting portions of the auxetic sole are in contact with a surface, the auxetic sole may attempt to expand or contract at the area of the surface. In some cases, the surface may restrict the auxetic sole from expanding or contracting. The auxetic sole may, however, provide increased traction and feel during these circumstances due to the increased surface area of the auxetic sole under the applied forces.

Figure 17:
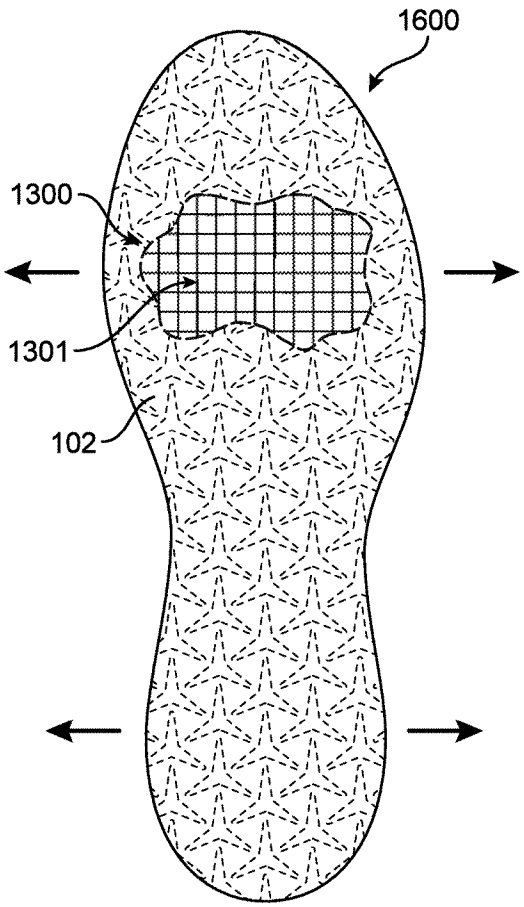
FIGS. 16-17 depict an embodiment of a strobel structure subjected to force.
Figure 16:
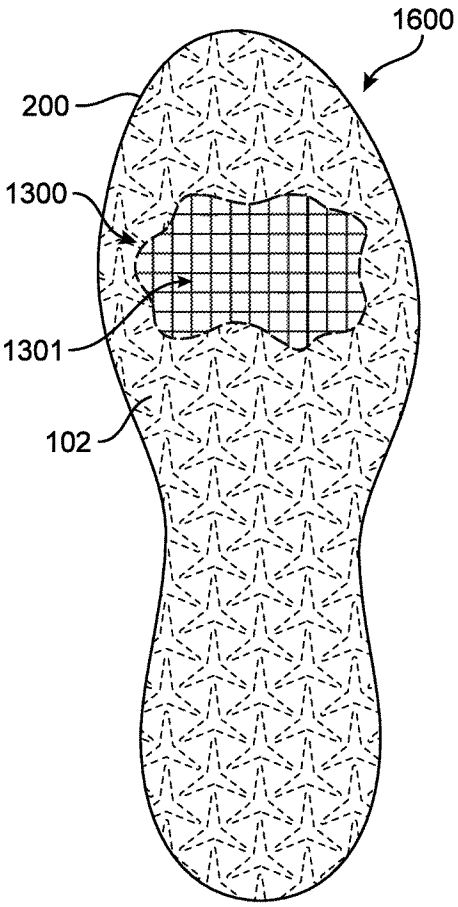

Referring to FIGS. 16-17, strobel 200 is depicted as attached to sole 102. Strobel 200 includes swatch 1300 and elements 1301, which illustrate the material configuration of strobel 200. As discussed above, the orientation of elements 1301 in swatch 1300 illustrates the directions along which strobel 200 resists stretch. As discussed above, in the exemplary embodiment, strobel 200 may have stretch-resistant properties in the lateral direction and the longitudinal direction.

The combination of strobel 200 and sole 102 may be referred to as strobel structure 1600. In FIG. 16, strobel structure 1600 is not acted on by external forces. In FIG. 17, strobel structure 1600 is subjected to tensile force along the lateral direction. As shown, strobel structure 1600 does not substantially change in shape or size when subjected to a force. Further, swatch 1300 stays in substantially the same shape and size before being subjected to the tensile force and after being subjected to the tensile force. Due to the stretch-resistant nature of strobel 200 in the lateral and longitudinal directions, strobel structure 1600 may remain in substantially the same shape before being subjected to a tensile force and while being subjected to a tensile force. Strobel 200 therefore may restrict sole 102 from expansion along the lateral direction or the longitudinal direction. That is, the auxetic nature of sole 102 may be limited.

Figure 19:
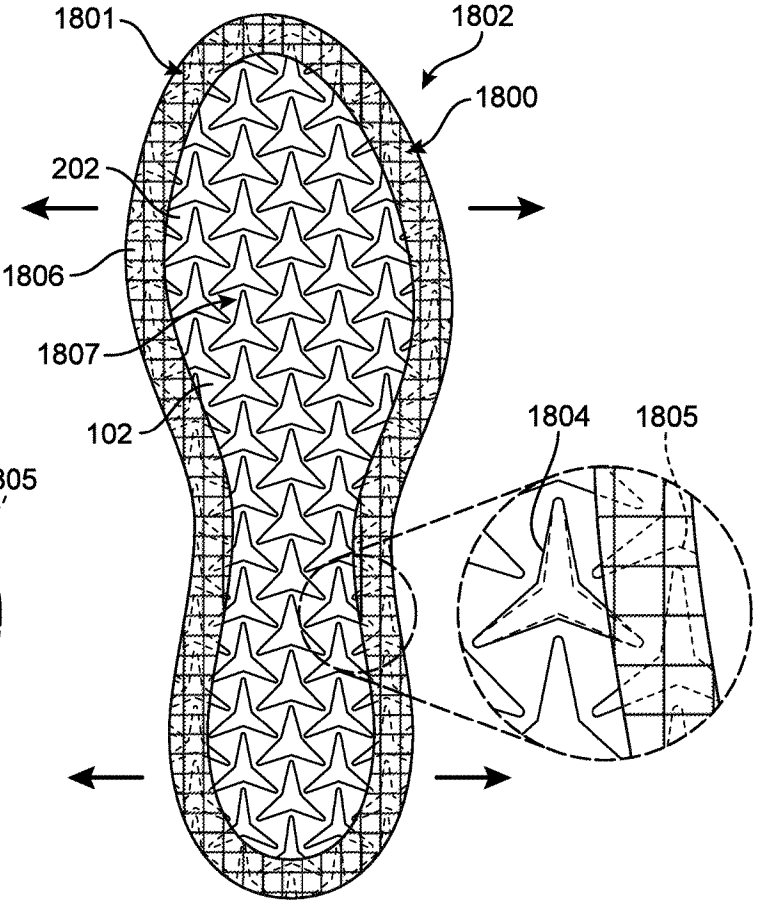
FIGS. 18-19 depict an alternate embodiment of a strobel structure subjected to force.
Figure 18:
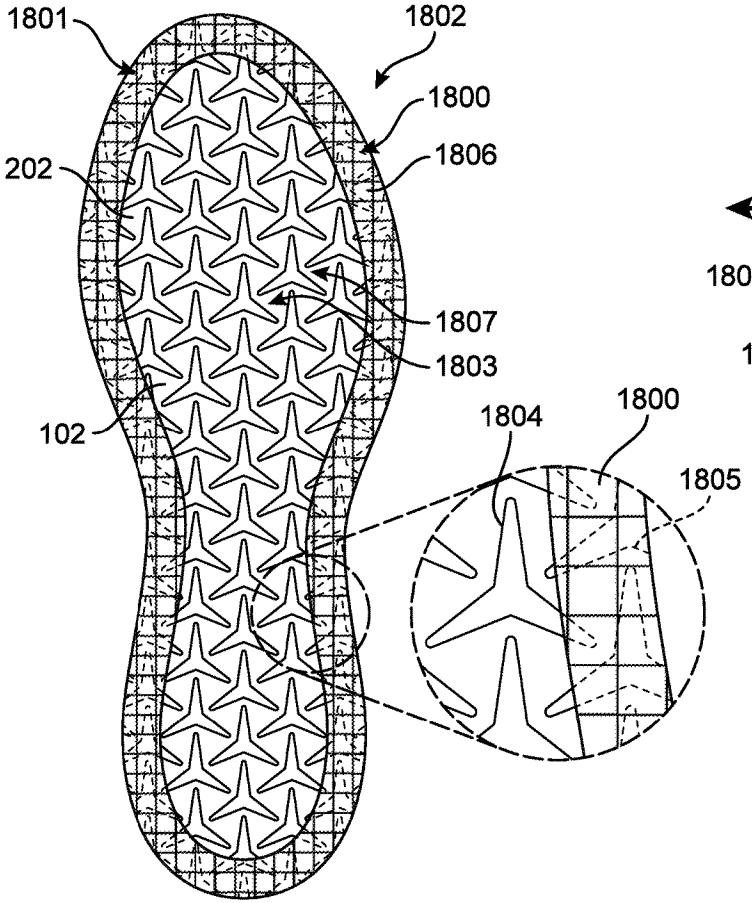

FIGS. 18-19 illustrate a non-tensioned configuration and a tensioned configuration, respectively, of another embodiment of sole 102 with a corresponding strobel 1800. Referring to FIGS. 18-19, strobel 1800 is depicted as attached to sole 102. Strobel 1800 includes elements 1801, which illustrate the material configuration of strobel 1800. The structure of strobel 1800 and sole 102 in combination is referred to as strobel structure 1802.

As seen in FIGS. 18 and 19, strobel 1800 comprises an outer portion 1806 and a central opening 1807. As discussed below, outer portion 1806 is a continuous material portion that may extend around the perimeter of sole 102. Moreover, outer portion 1806 bounds central opening 1807. When assembled together, the perimeter of sole 102 is covered by outer portion 1806, while other portions of sole 102 corresponding to central opening 1807 are exposed.

As shown, strobel 1800 has stretch-resistant properties in the longitudinal direction and lateral direction. Although strobel 1800 is shown with stretch-resistant properties in both the longitudinal direction and the lateral direction, it should be recognized that the properties of other strobels discussed within the description may be applicable to strobel 1800 as well.

Strobel 1800 covers the perimeter of upper surface 202 of sole 102. Strobel 1800 may be used to secure the perimeter area of sole 102 such that the perimeter area covered by outer portion 1806 of strobel 1800 resists movement or translation when a force acts upon strobel structure 1802 along the lateral or longitudinal direction. The use of strobel

1800 around the perimeter of upper surface 202 of sole 102 therefore may allow for a secure portion to which upper 101 may attach.

In some embodiments, upper 101 may be attached to strobel 1800. Although strobel 1800 does not completely cover sole 102, strobel 1800 may still help maintain the shape of sole 102, and therefore the shape of upper 101. Because strobel 1800 secures the outer perimeter of sole 102 from expansion, upper 101 that is attached to strobel 1800 likewise may be secured from expansion. Therefore, strobel 1800 may allow for sole 102 to resist stretching or twisting or distortion during use and when upper 101 is attached strobel 1800, upper 101 may to resist stretching, twisting, or distortion during use.

The enlarged portions of FIGS. 18-19 illustrate the particularized restriction of movement of sole 102. An aperture 1804 is shown to be substantially unencumbered by strobel 1800. A portion of aperture 1805 is shown to be substantially covered by strobel 1800. When strobel structure 1802 is subjected to force, aperture 1804 may expand or distort as shown in the FIG. 19. Conversely, aperture 1805 may be restricted by strobel 1800 such that aperture 1805 remains substantially unchanged in dimensions and shape when subjected to force.

The shape of strobel 1800 of strobel structure 1302 may allow for movement of sole 102 in middle portion 1803 of sole 102. Middle portion 1803 refers to the portion of upper surface 202 of sole 102 that is not covered by strobel 1800. As shown, middle portion 1803 is associated with central opening XX of strobel 1800 (i.e., middle portion 1803 is bounded by outer portion 1806 of strobel 1800).

Figure 20:
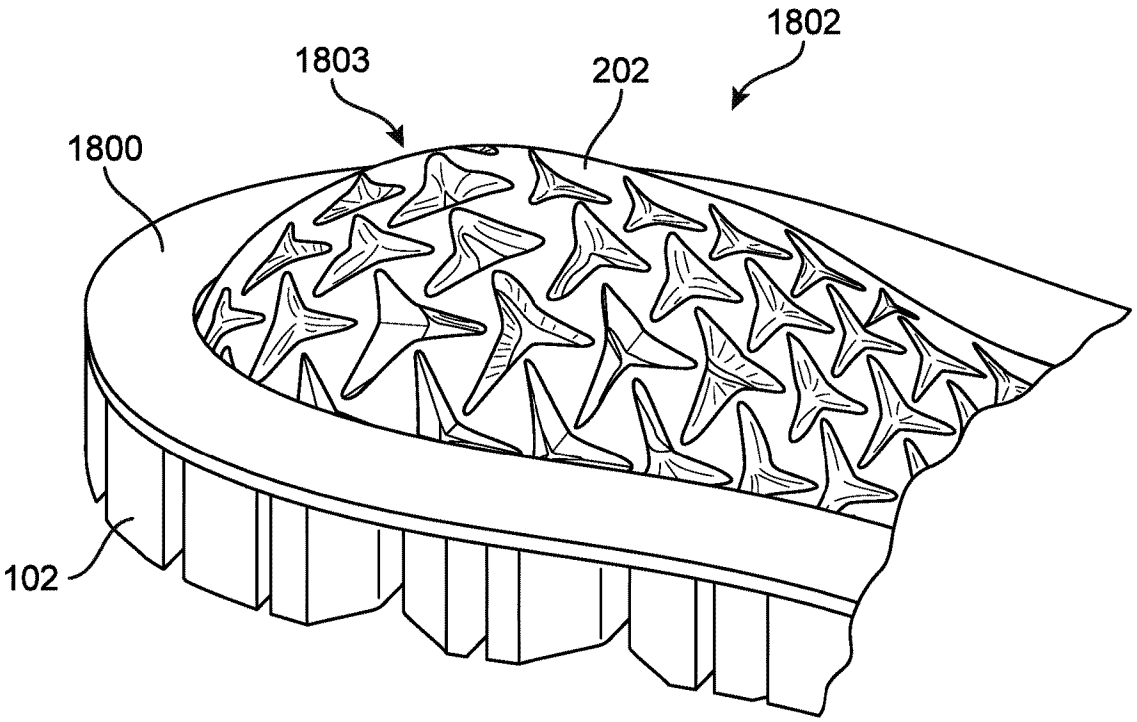
FIGS. 20-21 depict an embodiment of a portion of a strobel structure subjected to vertical force.
Figure 21:
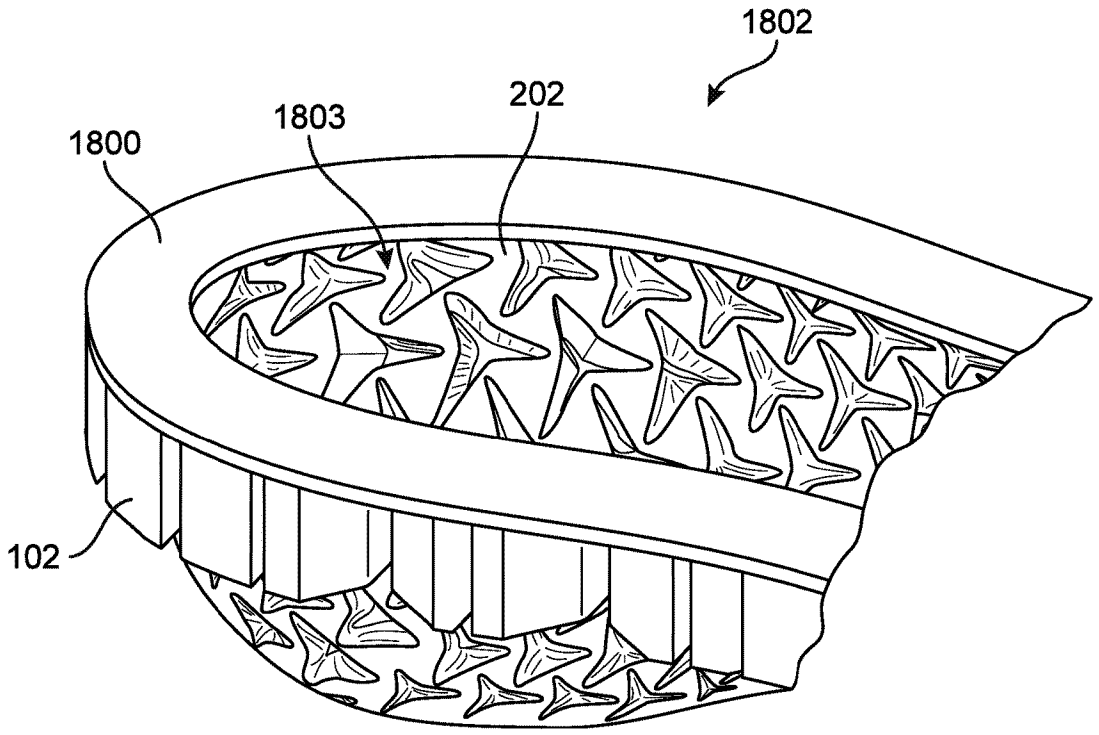

Due to strobel 1800 holding the perimeter of sole 102 essentially in the same position, sole 102 may not be able to expand in the same plane as strobel 1800 is located. Strobel 1800 may, however, allow for movement of sole 102 along different planes. As shown in FIGS. 20 and 21 heel region 103 of sole 102 is move along a vertical axis with respect to sole 102. Sole 102 may expand as sole 102 moves along the vertical axis, while strobel 1800 holds sole 102 largely in place along the perimeter of sole 102 in a different plane which is orthogonal to the vertical axis. Middle portion 1803 may allow for portions of a user's foot to enter into a different plane than the plane that includes strobel 1800. The freedom of movement in a different plane than strobel 1800 may increase comfort of a user, and may allow for more unrestricted movement than in other embodiments. Although middle portion 1803 may bend into a different plane than strobel 1800, strobel 1800 may still maintain the shape of the perimeter portion of sole 102. Likewise, upper 101 may maintain its shape.

In some embodiments, the area encompassed by sole 102 may be increased when exposed to a force. In some embodiments, as sole 102 bends or bulges in the vertical direction, as in FIGS. 20-21, the surface area of upper surface 202 of sole 102 may increase. The increase in the surface area of upper surface 202 may allow for the apertures to stretch along the lateral and longitudinal directions. In other embodiments, the surface area of upper surface 202 may decrease. In such embodiments, the apertures may contract in the lateral and longitudinal directions.

Middle portion 1803 may be varied in size. In some embodiments, middle portion 1803 may encompass a substantial portion of strobel structure 1802. In other embodiments, middle portion 1803 may encompass a smaller portion of strobel structure 1802. The size of middle portion 1803 may be determined by the shape and size of strobel 1800, as well as the shape and size of sole 102. Moreover, the size of middle portion 1803 may generally be selected to achieve desired flexing characteristics for one or more portions of sole 102.

In the embodiment depicted, strobel 1800 encompasses a small portion of the perimeter of upper surface 202 of sole 102. In other embodiments, strobel 1800 may be wider such that strobel 1800 may encompass a larger portion of the perimeter of upper surface 202 of sole 102. In such a configuration, middle portion 1803 may be smaller than as depicted in FIGS. 18-19. A smaller middle portion may be used in order to restrain movement in a larger area of strobel structure 1802. The restraint in movement of sole 102 may be used in order to maintain the integrity and shape of sole 102. A less wide strobel 1800 may be used to permit more freedom of movement within strobel structure 1802.

The shape of strobel 1800 may alter the shape of middle portion 1803. As shown, strobel 1800 maintains largely the same width along the perimeter of upper surface 202 of sole 102. The shape of strobel 1800 may be altered, however, to achieve a differently shaped middle portion 1303. For example, strobel 1800 may encompass a larger portion of sole 102 in heel region 103, midfoot region 104, or forefoot region 105. Further, middle portion 1803 may be circular, undulating, rectangular, or a regular or irregular shape. The different shapes of middle portion 1803 may be utilized to give particular support in some areas, while allowing for more stretch and movement of the auxetic structure. A strobel may encompass one or more of heel region 103, midfoot region 104, or forefoot region 105 so as to limit the vertical movement of sole 102 in a particular region. A strobel may be designed to encompass one or more of the regions discussed above in order to increase stability and control within article of footwear 100.

In some embodiments, sole 102 may be made of a compressible or stretchable material. That is, even without apertures, sole 102 may stretch when subjected to tensional force. In such cases, a strobel structure may expand along the lateral and longitudinal directions. Further, both the strobel and the sole may expand and/or distort when subjected to tensional force. Additionally, the middle portion may remain in the same plane as the strobel and still stretch along the longitudinal and lateral directions.

Figure 23:
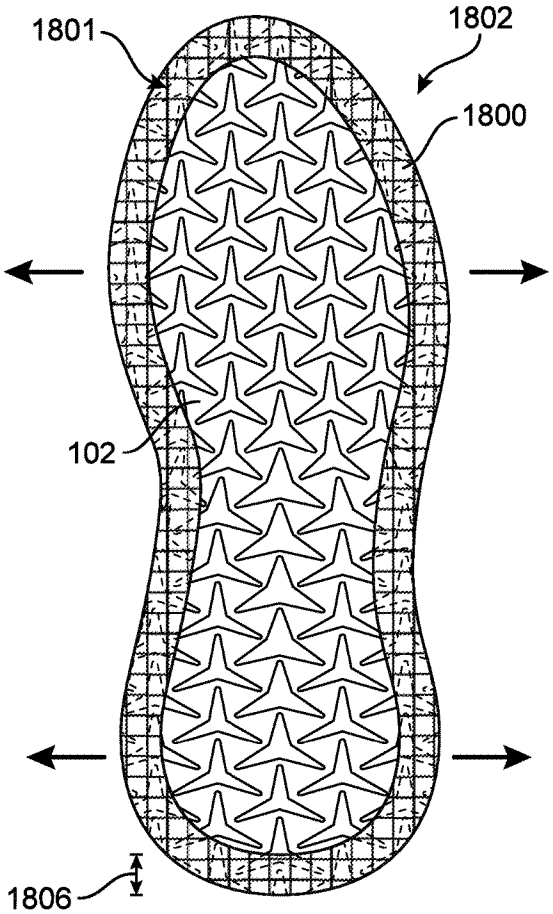
FIGS. 22-23 depict an embodiment of a strobel structure subjected to force.
Figure 22:
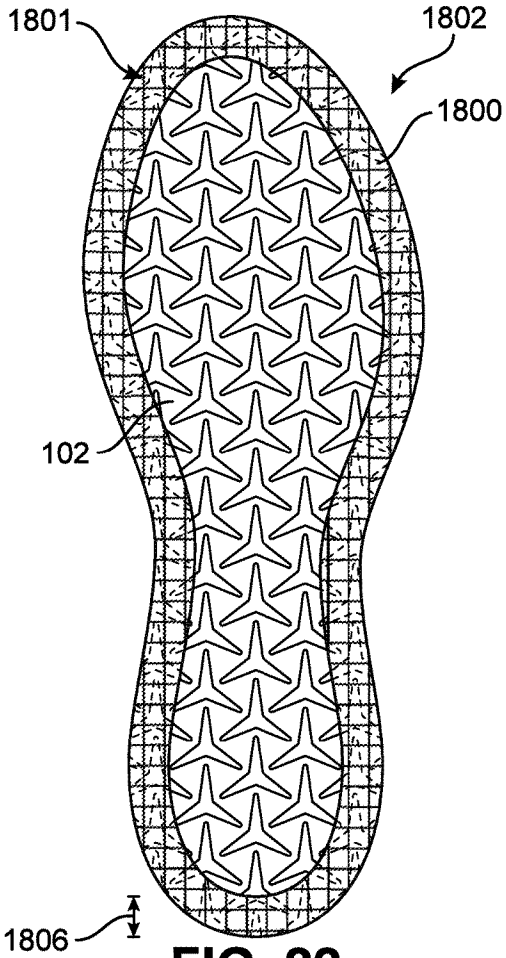

Referring to FIGS. 22-23, strobel structure 1802 is illustrated in an unaltered state in FIG. 22, and also when subjected to force in FIG. 23. While strobel 1800 may generally restrict motion in both the lateral direction and the longitudinal direction, in some embodiments, strobel structure 1802 may be able to change shape. As shown, the shape of strobel structure 1802 may be altered when subjected to force.

The overall circumferential length of strobel 1800 may remain the same distance. Further, the width of strobel 1800 may remain the same. For example, comparing heel region 103 of strobel structure 1802 in the unaltered state and when strobel structure 1802 is subjected to force, the shape of strobel structure 1802 changes when subjected to a force. As shown, heel region 103 of strobel structure 1802 diminishes in length and increases in width with respect to strobel structure 1802. Likewise, strobel 1800 follows the perimeter of sole 102 as sole 102 changes shape. Strobel 1800, however, remains the same width 1806 in both the unaltered state and when subjected to a force. Strobel 1800, therefore, may cover the same area of sole 102, over the same circumferential distance. Strobel 1800 may therefore be altered in shape, however, the dimensions of strobel 1800 may remain substantially the same.

Figure 25:
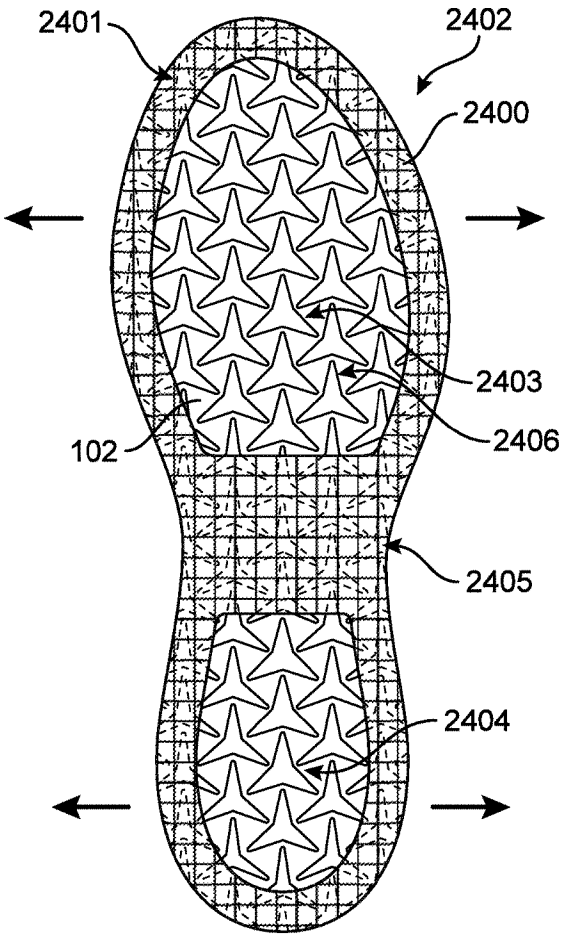
FIGS. 24-25 depict an alternate embodiment of a strobel structure subjected to force.
Figure 24:
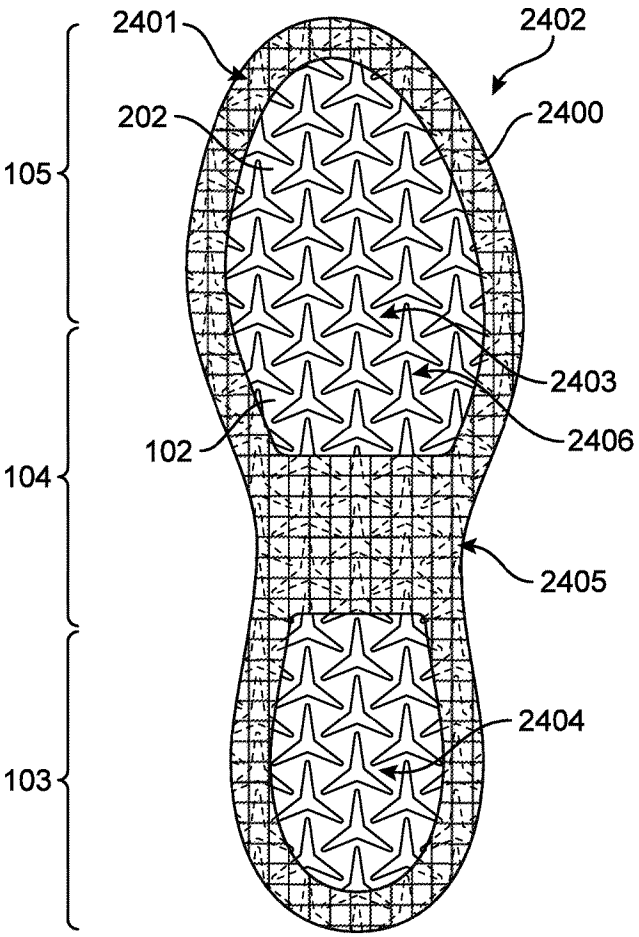

Referring now to FIGS. 24-25, another embodiment of a strobel is illustrated. In FIGS. 24-25, a strobel 2400 is shown covering the perimeter of upper surface 202 of sole 102. The structure of strobel 2400 and sole 102 in combination is referred to as strobel structure 2402. Elements 2401 illustrate the material configuration of strobel 2400. As shown, elements 2401 illustrate a material that is stretch-resistant along both the lateral direction and the longitudinal direction. As discussed above and throughout the description, the orientation of elements 2401 may be changed in order to achieve different properties such as stretch resistance in one direction or other properties.

Similarly to strobel structure 1802, strobel structure 2402 includes portions of sole 102 that are not covered by strobel 2400. In the embodiment shown, forefoot portion 2403, located at least partially in forefoot region 105, and heel portion 2404, located at least partially in heel region 103, are not covered by strobel 2400.

In some embodiments, midfoot portion 2405, located at least partially in midfoot region 104 of strobel structure 2402, is covered by strobel 2400. Midfoot portion 2405 may resist or restrain sole 102 from expanding or distorting laterally or longitudinally when subjected to a force. Midfoot portion 2405 may therefore provide support to the midfoot region 104 of a user's foot.

The shape and size of midfoot portion 2405 may be altered. For example, midfoot portion 2405 may extend towards forefoot region 105 or heel region 103. By extending the size of midfoot portion 2405, the amount of forefoot portion 2403 and heel portion 2404 covered by strobel 2400 would increase. Increasing or decreasing the size of midfoot portion 2405 covered by strobel 2400 may allow for more particularized support and stretch-resistance within strobel structure 2402.

Forefoot portion 2403 and heel portion 2404 may act similarly to middle portion 1803 of strobel structure 1802. That is, forefoot portion 2403 and heel portion 2404 may be configured to expand such that forefoot portion 2403 and heel portion 2404 are at least partially concave or convex with respect to a plane of sole 102. In other words, under applied tension, some of forefoot portion 2403 and heel portion 2404 could expand into the vertical direction. Forefoot portion 2403 and heel portion 2404 may extend in such a concave or convex manner when force is exerted along the vertical axis. The force may cause apertures 2406 to expand within portions that are not covered by strobel 2400.

As discussed with relation to strobel structure 1802, strobel structure 2402 may include a differently oriented and shaped strobel. Strobel 2400 may include different thicknesses along forefoot region 105 as compared to heel region 103. For example, the portion of forefoot region 105 most associated with the toes may include a thicker or wider portion of strobel 2400 than in the comparative part of heel region 103. Many combinations of shapes and thicknesses of strobel 2400 may be utilized for particular purposes and the exemplary depiction shown in FIGS. 24-25 is not meant to be a limiting embodiment.

Figure 27:
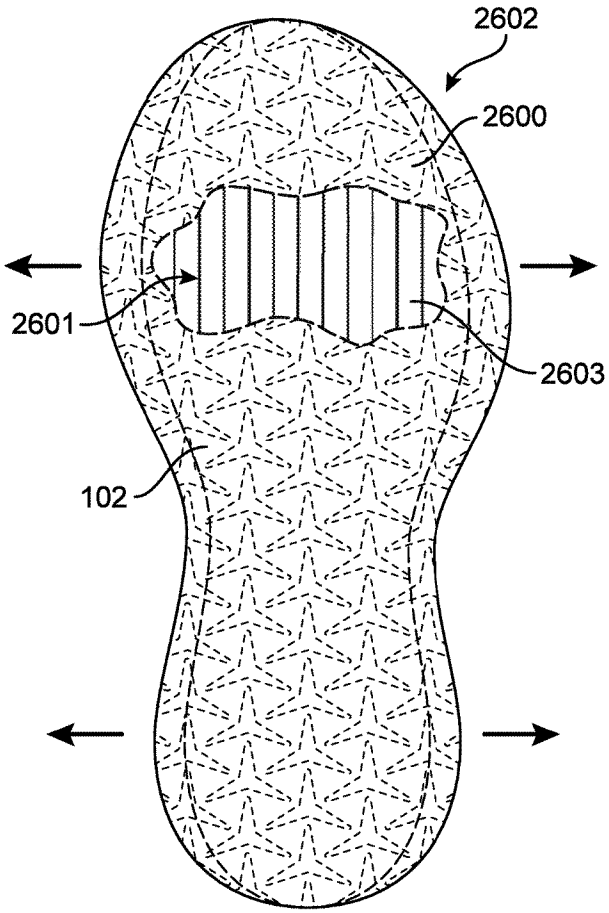
FIGS. 26-27 depict an alternate embodiment of a strobel structure subjected to force.
Figure 26:
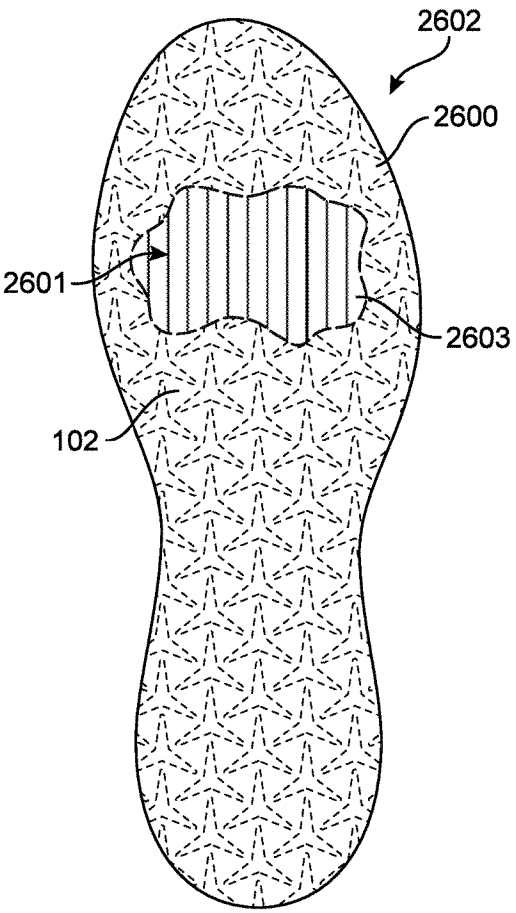

Referring to FIGS. 26-27, a strobel structure is depicted with stretch-resistant properties in one direction. As shown, strobel 2600 completely covers sole 102. The combination of strobel 2600 and sole 102 is referred to as strobel structure 2602. Strobel 2600 is shown with a swatch 2603 that includes elements 2601. Swatch 2603 is a representative portion of strobel 2600 and may be assumed to be located throughout strobel 2600.

Elements 2601 within swatch 2603 indicate the stretch-resistant nature of the material used to make strobel 2600. As shown, elements 2601 are oriented along the longitudinal direction which indicates that the material used to make strobel 2600 resists stretch along the longitudinal direction.

FIG. 27 depicts strobel structure 2602 being subjected to a force. Strobel 2600 and sole 102 stretch along the lateral direction due to the force, however, the auxetic nature of sole 102 is limited along the longitudinal direction. That is, strobel 2600 prevents sole 102 from extending along the longitudinal direction, unlike portion 400 of FIG. 4.

As discussed above and later in the description, the shape and layout of strobel 2600 may be changed and combined with other layouts depicted for certain purposes. For example, a portion of heel region 103 may not be covered by strobel 2600. In other embodiments, strobel 2600 may be similar in appearance to strobel 2400 or strobel 1800, but be constructed with a material that restricts stretch in the longitudinal direction.

Figure 28:
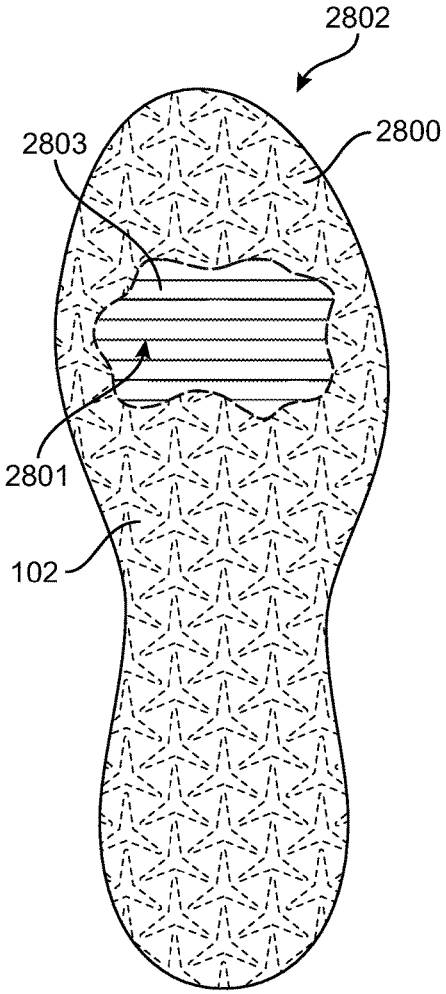
FIGS. 28-29 depict an alternate embodiment of a strobel structure subjected to force.
Figure 29:
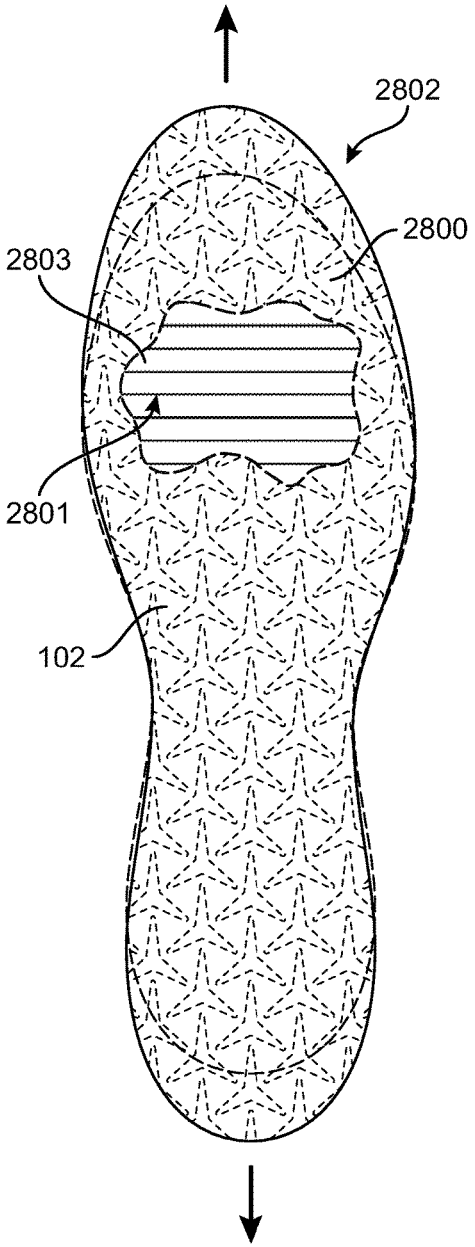

Referring to FIGS. 28-29, a strobel structure is depicted with stretch-resistant properties in one direction. As shown, strobel 2800 completely covers sole 102. The combination of strobel 2800 and sole 102 is referred to as strobel structure 2802. Strobel 2800 is shown with a swatch 2803 that includes elements 2801. Swatch 2803 is a representative portion of strobel 2800 and may be assumed to be located throughout strobel 2800.

Elements 2801 within swatch 2803 indicate the stretch-resistant nature of the material used to make strobel 2800. As shown, elements 2801 are oriented along the lateral direction which indicates that the material used to make strobel 2800 resists stretch in the lateral direction.

FIG. 29 depicts strobel structure 2802 being subjected to a force. Strobel 2800 and sole 102 stretch along the longitudinal direction due to the force, however, the auxetic nature of sole 102 is limited along the lateral direction. That is, strobel 2800 prevents sole 102 from extending along the lateral direction, unlike portion 400 of FIG. 4.

As discussed above and later in the description, the shape and layout of strobel 2800 may be changed and combined with other layouts depicted for certain purposes. For example, a portion of heel region 103 of sole 102 may not be covered by strobel 2800. In other embodiments, strobel 2800 may be similar in appearance to strobel 2400 or strobel 1800, but be constructed with a material that restricts stretch in the longitudinal direction.

In some embodiments, a strobel may be utilized with different properties in different areas. In some embodiments, a portion of a strobel may include one property and a different portion may include a different property. In some embodiments, multiple areas of a strobel may include different properties. That is, materials with different properties may be oriented throughout a strobel. In some embodiments, a first portion may include stretch-resistant properties along a lateral direction and a second portion may include stretch-resistant properties along a longitudinal direction.

Figure 30:
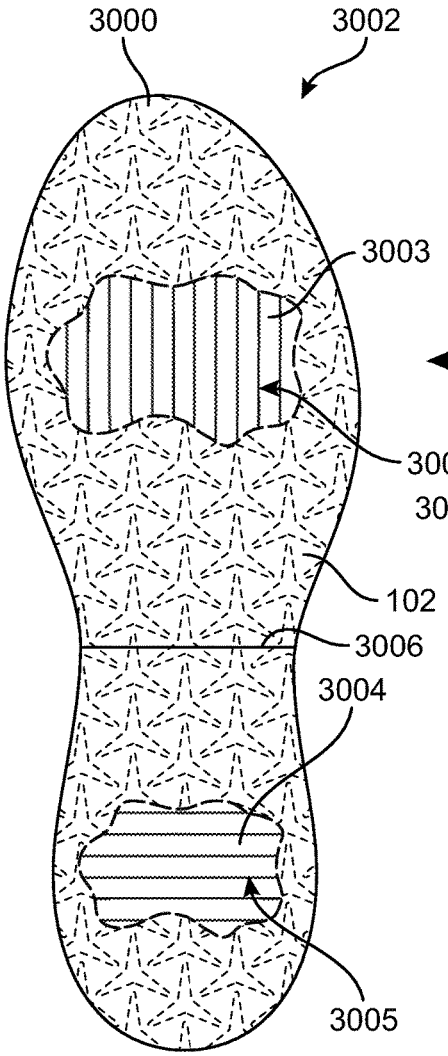
FIGS. 30-31 depict an alternate embodiment of a strobel structure subjected to force.
Figure 31:
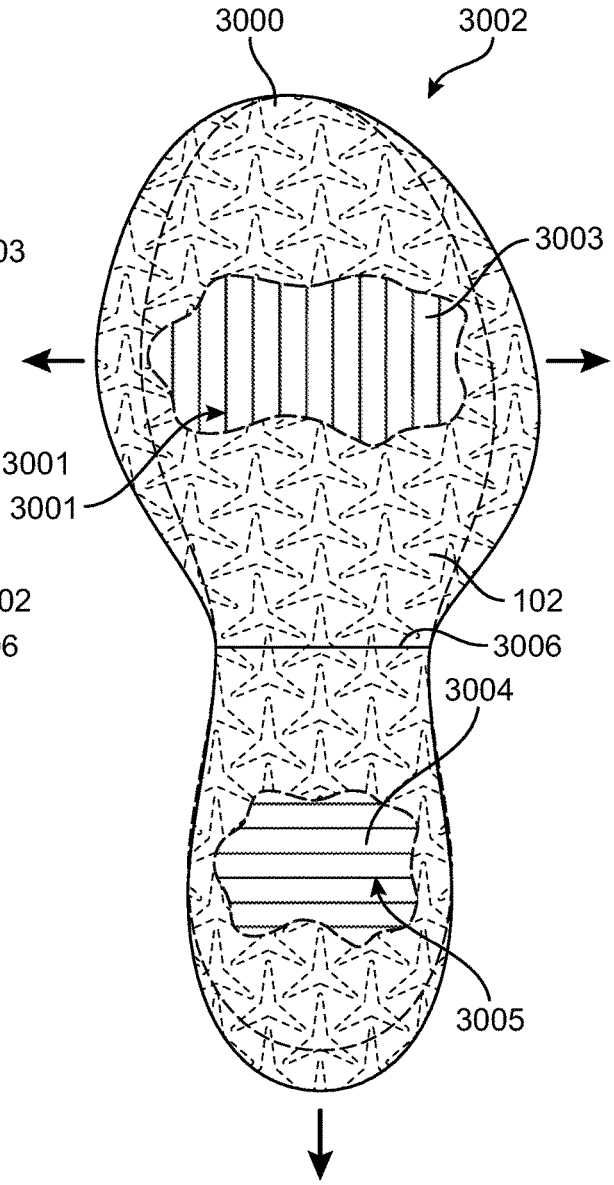

Referring to FIGS. 30-31, a strobel structure is depicted with different stretch-resistant properties in different areas. As shown, strobel 3000 completely covers sole 102. The combination of strobel 3000 and sole 102 is referred to as strobel structure 3002.

Strobel 3000 is shown with a swatch 3003 that includes elements 3001. Strobel 3000 further is shown with a swatch 3004 that includes elements 3005. Swatch 3003 is a representative portion of strobel 3000 and may be assumed to be located throughout forefoot region 105 to a junction 3006 of strobel 3000. Swatch 3004 is a representative portion of strobel 3000 and may be assumed to be located throughout the heel region 103 to junction 3006 of strobel 3000.

Elements 3001 and elements 3005 depict the stretch-resistant nature of strobel 3000 within different regions of strobel 3000. Elements 3001 depict a stretch-resistant property along the longitudinal direction. Elements 3005 depict a stretch-resistant property along the lateral direction.

The portion of strobel 3000 from junction 3006 to forefoot region 105 includes a stretch-resistant property along the longitudinal direction. The portion of strobel 3000 from junction 3006 to heel region 103 includes a stretch-resistant property along the lateral direction.

While junction 3006 is shown as a precise demarcation between the different properties of strobel 3000, in other embodiments, junction 3006 may be less rigid, or exact. Further, many junctions may exist in other strobels which utilize strobels with multiple properties. Additionally, junctions may be smoother such that an overlap of properties may exist for a portion of the strobel. That is, in some embodiments the transition from one material property to another may be gradual in nature.

Junction 3006 additionally may be differently shaped and moved throughout strobel 3000. In some embodiments, junction 3006 may run directly from lateral to medial side of sole 102. In other embodiments, junction 3006 may be run in a diagonal manner. In still further embodiments, junction 3006 may include curves or may be irregularly shaped.

In some embodiments, multiple junctions may be utilized. In some embodiments, strobels may include different areas with differing properties. In such cases, the different areas of the strobel may be connected at a junction.

Referring to FIG. 31, strobel structure 3002 is subjected to force. In forefoot region 105 the force is exerted along the lateral direction. In heel region 103 the force is exerted along the longitudinal direction. As shown, strobel structure 3002 stretches along the lateral direction in forefoot region 105 but not in the longitudinal direction. Strobel structure 3002 stretches along the longitudinal direction in heel region 103, but not in the lateral direction. The stretch-resistant properties of strobel 3000 within each region restrict sole 102 from expanding in both directions. While the illustrations in FIGS. 30-31 show two materials with a precise demarcation, it should be recognized that multiple areas along the entire length of strobel 3000 may include multiple different materials with different properties and orientations.

In some embodiments, the forefoot region may include elements that are oriented along the lateral direction. In such embodiments, the sole structure may resist stretch along the lateral direction. As a user cuts, or moves laterally, the elements within the sole structure may resist stretching and allow for the sole to remain stable. Further, in such a configuration, as a user pushes off of the forefoot region in a forward motion (i.e. stretching the sole structure longitudinally), the sole may expand in the longitudinal direction. The expansion of the sole in the longitudinal direction may increase traction or grip as a user seeks to move in a forward direction. In certain embodiments, a user may desire more support and stability in the midfoot region than in other regions of an article. As such, a strobel structure may include a stretch resistant portion of the strobel in the midfoot region. The strobel in the midfoot region may resist stretch in both the lateral direction and the longitudinal direction.

Figure 32:
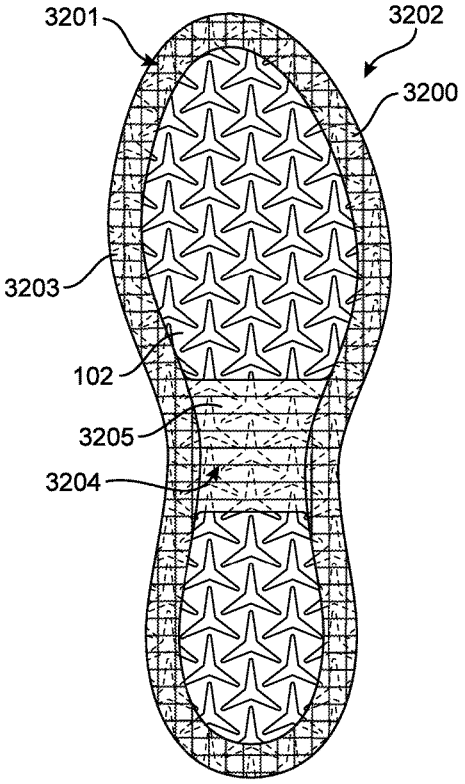
FIGS. 32-33 depict an alternate embodiment of a strobel structure subjected to force.
Figure 33:
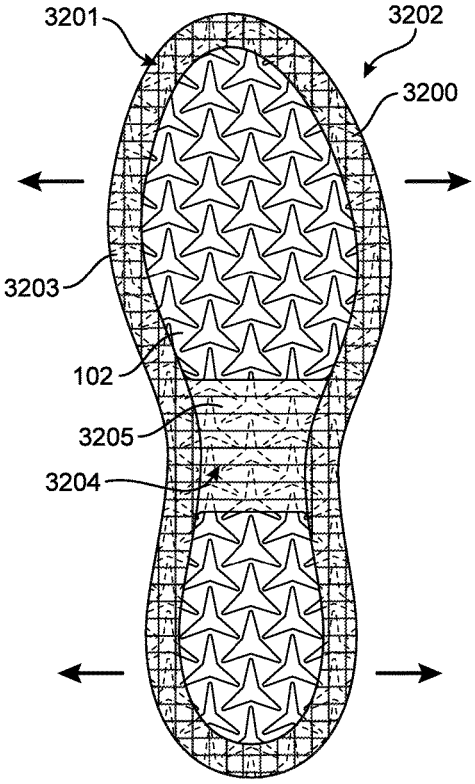

Referring to FIGS. 32-33, an embodiment of a strobel structure is depicted that utilizes multiple features previously discussed. A strobel 3200 is shown covering the perimeter of upper surface 202 of sole 102. The structure of strobel 3200 and sole 102 in combination is referred to as strobel structure 3202. Elements 3201, illustrate the material configuration of strobel 3200 around a perimeter portion 3203 of sole 102. As shown, elements 3201 illustrate a material that is stretch-resistant along both the lateral direction and the longitudinal direction. As discussed above and throughout the description, the orientation of elements 3201 may be changed in order to achieve different properties such as stretch resistance in one direction or other properties.

In some embodiments strobel structure 3202 may include a middle portion 3205. In some embodiments, middle portion 3205 may include a material configuration that is different than the material configuration of perimeter portion 3203. As shown, elements 3204 are oriented in the lateral direction. As such, elements 3204 may provide stretch resistance in the lateral direction. In contrast to perimeter portion 3203, middle portion 3205 may allow for greater stretch in the longitudinal direction.

Strobel structure 3202 may react similarly to force as the structure in FIGS. 24-25. Strobel structure 3202 may, however, allow sole 102 to expand in the longitudinal direction within middle portion 3205 when subjected to a force.

The embodiments discussed previously in the description may be combined or altered in conjunction with other embodiments. For example, a strobel with multiple materials of different properties may include cutouts, or may be formed around the perimeter of a sole. Many combinations of the above embodiments may be possible, and the embodiments discussed above are not meant to be limiting.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising:

an upper;

a sole with a forefoot region, a midfoot region and a heel region, the sole including a first direction and a second direction, the second direction being orthogonal to the first direction;

the sole including a plurality of apertures that extend from an upper surface of the sole to a lower surface of the sole;

the plurality of apertures including a first aperture associated with a first group of portions;

the first group of portions including a first portion and a second portion, the first portion being joined to the second portion at a hinge portion, wherein the first portion and the second portion can rotate with respect to each other about the hinge portion;

wherein the first portion and the second portion are configured to rotate away from one another when a tensioning force is applied at the hinge portion in a first direction, the first direction being oriented away from the first aperture;

a strobel attached to the upper surface of the sole the strobel having a first portion and a second portion, the first portion of the strobel extending along a perimeter of the sole, the second portion of the strobel being located interior to the first portion such that the first portion is on opposing sides of the second portion;

the first portion of the strobel having a first stretch resistance in the first direction and a second stretch resistance in the second direction;

the second portion of the strobel having a third stretch resistance in the first direction and a fourth stretch resistance in the second direction;

wherein the first stretch resistance is greater than the third stretch resistance and the fourth stretch resistance is greater than the second stretch resistance.

2. The article of claim 1, wherein the first portion of the strobel and the second portion of the strobel abut each other at a junction.

3. The article of claim 2, wherein the junction is located in the forefoot region of the sole.

4. The article of claim 2, wherein the junction is located in the midfoot region of the sole.

5. The article of claim 2, wherein the first portion and the second portion overlap each other at the junction.

6. The article of claim 1, wherein the first direction extends laterally across the sole.

7. The article of claim 1, wherein the first direction extends longitudinally across the sole.

8. A sole structure comprising:

a sole including an upper surface and a lower surface, the sole having an auxetic structure;

the auxetic structure including:

a plurality of apertures that extend through the sole from the upper surface to the lower surface, the plurality of apertures being surrounded by a plurality of portions, wherein each aperture in the plurality of apertures has a plurality of sides defined by a group of portions surrounding the aperture;

the plurality of apertures including a first aperture associated with a first group of portions;

the first group of portions including a first portion and a second portion, the first portion being joined to the second portion at a hinge portion, wherein the first portion and the second portion can rotate with respect to each other about the hinge portion;

wherein the first portion and the second portion rotate away from one another when a tensioning force is applied at the hinge portion in a first direction, the first direction being oriented away from the first aperture;

the sole structure including a strobel;

the strobel having a first portion that extends along a perimeter of the sole, the first portion having a first stretch resistance in the first direction and a second stretch resistance in the second direction;

the strobel having a second portion that extends between the first portion, the second portion having a third stretch resistance in the first direction;

wherein the third stretch resistance is less than the first stretch resistance.

9. The sole structure according to claim 8, wherein the second portion is located in a midfoot region of the sole structure.

10. The sole structure according to claim 8, wherein the first direction extends longitudinally along the sole structure.

11. The sole structure according to claim 8, wherein a first portion of a first aperture of the plurality of apertures is covered by the second portion of the strobel and at least a second portion of the first aperture of the plurality of apertures remains uncovered by the second portion of the strobel.

12. The sole structure according to claim 8, wherein the second portion of the strobel is located in a central region between portions of the first portion of the strobel.

13. The sole structure according to claim 8, wherein the first portion extends continuously around the perimeter of the sole.

* * * * *